US009733619B2

(12) United States Patent
Rombach

(10) Patent No.: US 9,733,619 B2
(45) Date of Patent: Aug. 15, 2017

(54) COUPLING MECHANISM FOR DATE DISPLAY DISCS

(71) Applicant: ETA SA Manufacture Horlogere Suisse, Grenchen (CH)

(72) Inventor: Stefan Rombach, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 19 days.

(21) Appl. No.: 14/982,379

(22) Filed: Dec. 29, 2015

(65) Prior Publication Data

US 2016/0195851 A1 Jul. 7, 2016

(30) Foreign Application Priority Data

Dec. 30, 2014 (EP) ..... 14200610

(51) Int. Cl.
*G04B 19/253* (2006.01)
*G04B 19/247* (2006.01)

(52) U.S. Cl.
CPC ..... *G04B 19/247* (2013.01); *G04B 19/25366* (2013.01)

(58) Field of Classification Search
CPC ..... G04B 19/247; G04B 19/253
USPC ..... 368/35, 37
See application file for complete search history.

(56) References Cited

U.S. PATENT DOCUMENTS 7,457,202 B2 * 11/2008 Takahashi ..... G04B 19/25333 368/28
2003/0103417 A1 6/2003 Gabathuler et al.
2005/0174891 A1 * 8/2005 Besse ..... G04B 19/25366 368/37
2006/0028918 A1 * 2/2006 Groothuis ..... G04B 19/247 368/37
2006/0098535 A1 * 5/2006 Marki ..... G04B 11/008 368/37
2012/0213037 A1 8/2012 Schmidt

FOREIGN PATENT DOCUMENTS

| | | | |
|---|---|---|---|
| CH | 690 869 | A5 | 2/2001 |
| EP | 1 316 859 | A1 | 6/2003 |
| EP | 1 609 028 | A2 | 12/2005 |
| EP | 2 490 083 | A1 | 8/2012 |
| JP | 2005-134265 | | 5/2005 |

OTHER PUBLICATIONS

European Search Report issued Oct. 28, 2015 in European Application 14200610, filed on Dec. 30, 2014 ( with English Translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

Grand date calendar display device for a watch movement comprising a first disc and a second disc, arranged to display, at least on certain dates, first date values through a combination of symbols borne by the first disc and symbols borne by the second disc, wherein the device includes a first coupling mechanism and a second coupling mechanism between the first disc and the second disc such that, at least on certain dates, the first disc drives the second disc, and on certain other dates, the second disc drives the first disc.

11 Claims, 17 Drawing Sheets

COUPLING MECHANISM FOR DATE DISPLAY DISCS

This application claims priority from European Patent Application No. 14200610.5 filed Dec. 30, 2014, the entire disclosure of which is hereby incorporated herein by reference.

FIELD OF THE INVENTION

The present invention concerns a date display mechanism, and in particular a "grand date" calendar display mechanism. It more particularly concerns a bidirectional coupling mechanism between two display discs.

BACKGROUND OF THE INVENTION

Conventional calendar display devices for timepieces, and in particular wearable wristwatches, usually use an annular date-disc including 31 regularly distributed annular sectors, each of the sectors including a symbol or indication corresponding to one of the possible dates of the month. The date-disc is indexed by one position every day, so as to reveal through an aperture the date value corresponding to each day, which is formed of one or more numerals. The angular sector occupied by each indexing position is thus relatively limited (360/31 i.e. slightly less than 12 degrees), which greatly restricts the maximum size of the numbers that can be displayed therein.

In order to increase the size of the symbols displayed in the aperture for reading the date, there therefore exist systems using two distinct discs, one for the display of the tens numeral and the other for the display of the units numeral of the date. This type of calendar display combining two numerals borne by two distinct discs is referred to as a "grand date" display. These display devices are coupled to a control device for respectively indexing each of the discs in order to display every day the exact combination of units and tens.

There is known, for example, a "grand date" display mechanism including a units ring comprising the units sequence 0-9, and a tens disc including a sequence of four numerals 0-3 distributed over sectors of approximately 90° each, like that described in EP Patent No 2490083. A date programme wheel with 31 sectors, driven at a rate of one step per day, meshes on two separate planes respectively with a tens disc and a units ring, to respectively drive the units disc every day, except on the change from the 31st day of the month to the first day of the following month, by means of 30 teeth followed by a toothless sector—the 31st of the date programme wheel—and the tens disc is only driven four times per month for the change to the next ten and the change of month (9->10, 19-20, 29-30 and 31->01) by means of long teeth respectively arranged on the 9th, 29th and 31st sectors of the 31 gear sectors of the programme wheel, and which drives a cross integral in rotation with the tens wheel. This date programming mechanism thus uses two distinct kinematic chains from the date programme wheel, driven at a rate of one step per day by a 24 hour wheel, without any mutual interaction between the tens display disc and the units display disc. Indeed, each of the 31 gear sectors of the date programme wheel meshes selectively plane-by-plane with each of the discs concerned to display each date value throughout the month.

One drawback of this type of calendar mechanism is that it requires a very large number of parts, which are separate for the control and display mechanism, and therefore occupy too much space on the plate. Further, the cross associated with the tens disc has a very small number of teeth, which is detrimental to gearing reliability due to the large angular steps required during each indexing operation.

Other types of "grand date" display mechanisms are also known, for example from EP Patent No 1609028, using a combined solution with a modified tens disc that can sometimes contain two numerals for certain dates. This solution discloses a device for coupling the disc bearing the units to that bearing the tens, the units disc bearing lugs for driving the tens disc on certain dates. According to this display solution, the fact that the modified tens disc bears a larger number of symbols certainly facilitates the gearing mechanism, but because the sequence of symbols relating to the units is arranged on a disc integral in rotation with a programme wheel having 31 sectors, the maximum size of the characters that can be displayed consequently still remains very limited.

BRIEF SUMMARY OF THE INVENTION

It is an object of the present invention to provide a calendar display mechanism that is free of these known limitations.

It is another object of the present invention to provide a new type of grand date display mechanism by combining two discs for at least some dates, using original display and symbol sequences, and an original drive mechanism.

These objects are notably achieved by the features of a grand date display mechanism according to the main claim, and in particular a grand date display device for a watch movement comprising a first disc and a second disc arranged to display, at least on certain dates, first date values by combining symbols or indications borne by the first disc and symbols or indications borne by the second disc, characterized in that the device includes a first mechanism for coupling the first disc to the second disc, and a second mechanism for coupling the second disc to the first disc such that, at least on certain dates, the first disc drives the second disc, and on certain other dates, the second disc drives the first disc.

Specific embodiments of the invention are defined in the dependent claims.

One advantage of the present invention is that it makes it possible to modify the cycles and programming of display sequences, via the mutual driving of each of the discs by the other, and thereby to better balance the symbols or indications borne by the two discs, for example by adding certain units symbols to a modified dates disc. According to a preferred embodiment, the number of display symbols borne by each of the discs is exactly the same, allowing the size of the characters to be best adjusted for a combined display.

Another advantage of the proposed solution is that it decreases the number of parts required to make the display device, by merging the functional programming part with that of the actual date display.

According to a preferred embodiment, the two display discs are formed by rotating elements of substantially annular shape, i.e. whose display symbols extend over a complete annular segment extending over 360 degrees during one cycle, typically of one month. When the symbols of the two discs are arranged to cover the same annular surface and are superposed on each other for at least some dates, the display is confined in a small space and the control mechanism may even advantageously be incorporated at the centre of the ring for increased compactness.

BRIEF DESCRIPTION OF THE DRAWINGS

Advantageous example implementations of the invention are given by way of non-limiting example in the description and illustrated in the annexed Figures, in which.

the series of FIGS. 5A, 5B, 5C, 5D, 5E, 5F illustrate various views to explain the indexing mechanism of the first and second disc according to a preferred embodiment, during a first sequence for dates where the units are comprised between 2 and 9.

the series of FIGS. 6A, 6B, 6C, 6D, 6E, 6F and 6G illustrate various views to explain the indexing mechanism of the first and second disc according to a preferred embodiment, during a second sequence for the change of date to the next ten (9->10, 19->20, 29->30).

the series of FIGS. 7A,7B,7C,7D,7E,7F illustrate various views to explain the indexing mechanism of the first and second disc according to a preferred embodiment during a third sequence for the change from a whole ten to the next date ending in 1 (10->11, 20->21, 30->31).

the series of FIGS. 8A,8B,8C,8D,8E,8F illustrate various views to explain the indexing mechanism of the first and second disc according to a preferred embodiment during a fourth sequence for the change from dates ending in 1 to dates ending in 2 (01->02, 11->12, 21->22).

finally, the series of FIGS. 9A, 9B, 9C, 9D, 9E, and 9F illustrate various views to explain the indexing mechanism of the first and second disc according to a preferred embodiment, during a fifth sequence for the change from the last (31st) day of the month to the 1st day of the next month (31->01).

EXAMPLE EMBODIMENT(S) OF THE INVENTION

Figure 10:
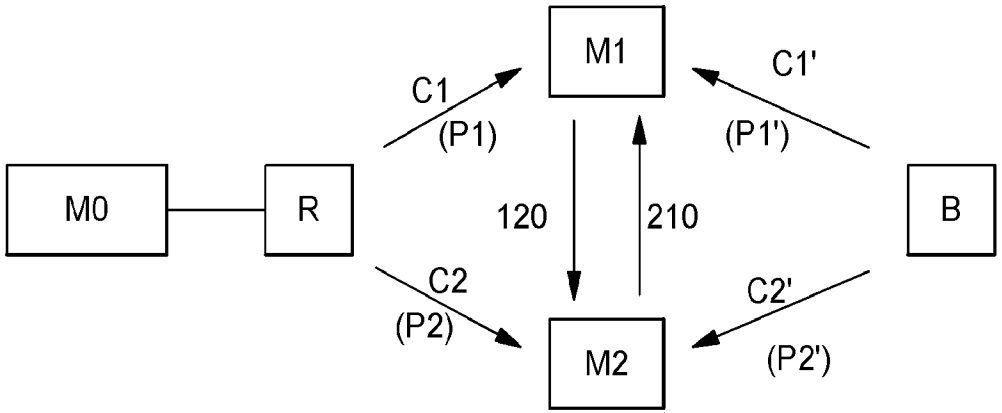
FIG. 10 shows a schematic view of the kinematic chains and bidirectional coupling mechanism between the two display discs used in a preferred embodiment of the present invention.

FIG. 10 is a schematic view explaining the operating principle of the bidirectional coupling mechanism between two display discs according to the invention, preferably the first disc M1 illustrated below in FIG. 1A and the second disc illustrated in FIG. 1B, in a control mechanism preferably using a basic movement driving in rotation a cannon-pinion M0 meshing with a drive wheel R making one complete rotation every 24 hours for the daily indexing of the proposed display device, and an independent corrector wheel B, actuated in rotation for example by an external control stem, such as those illustrated in the following FIG. 1C.

First disc M1 is thus selectively driven, directly or indirectly, according to the value of the current date, by 24-hour drive wheel R via a first kinematic chain, while second disc M2 is also selectively driven, directly or indirectly and according to the value of the current date, by the same 24-hour drive wheel via a second, distinct and independent kinematic chain, as in certain of the aforementioned prior art mechanisms. For some dates, and in the preferred embodiment described and illustrated in the following Figures, for example the change from the 9th to the 10th day of the month, from the 19th to the 20th day of the month, and finally from the 29th to the 30th day of the month, a first mechanism 120 for coupling first disc M1 to second disc M2 allows second disc M2 to be driven by first disc M1, without the latter being directly driven by 24-hour drive wheel R, and vice versa, for the change from the 1st to the 2nd, from the 11th to the 12th, and finally from the 21st to the 22nd day of the month, a second mechanism 210 for coupling second disc M2 to first disc M1 allows first disc M1 to be driven by second disc M2, without the latter being directly driven by the 24-hour drive wheel R. These coupling mechanisms are thus used, in the preferred embodiment described, for respectively the second indexing sequence, illustrated by the following series of FIGS. 6 A-G, and the fourth indexing sequence, illustrated by the following series of FIGS. 8 A-F.

FIG. 10 refers to two series of two kinematic chains, and two series of corresponding gear planes. These references will be better understood in view of the following FIGS. 3A-B and 4A-B, illustrating the first main gear plane P1 in which a first main toothing D1 of first disc M1 meshes with a first tooth Rd1 of drive wheel R, the second main gear plane P2 in which a second main toothing D2 of second disc M2 meshes with a second tooth Rd2 of drive wheel R. Similarly, the first auxiliary gear plane P1' refers to the plane in which the first auxiliary toothing D1' of first disc M1 meshes with one of the teeth of corrector wheel B, and the second auxiliary gear plane P2' refers to the plane in which the second auxiliary toothing D2' of second disc M2 meshes with one of the teeth of corrector wheel B. There is consequently a first main kinematic chain C1 between drive wheel R and first disc M1, and a second main kinematic chain C2 between drive wheel R and second disc M2, and a first auxiliary kinematic chain C1' between corrector wheel B and first disc M1, and a second auxiliary kinematic chain C2' between corrector wheel B and second disc M2.

Figure 1A:
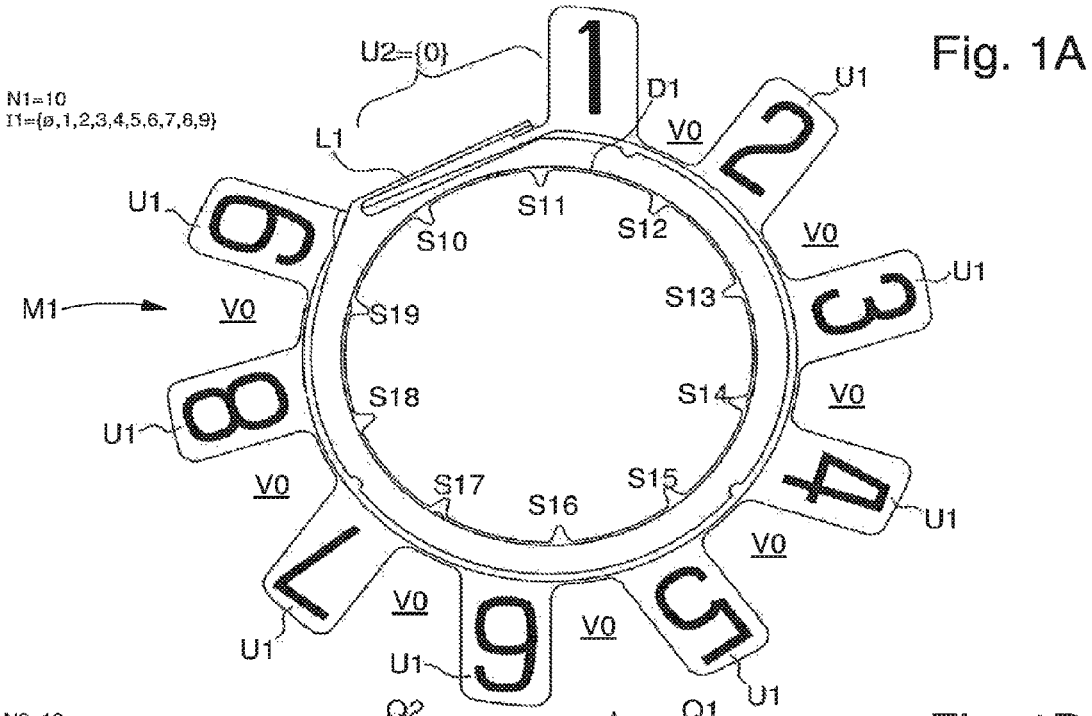
FIGS. 1A and 1B respectively illustrate a first modified units disc and a second modified tens disc.
Figure 1B:
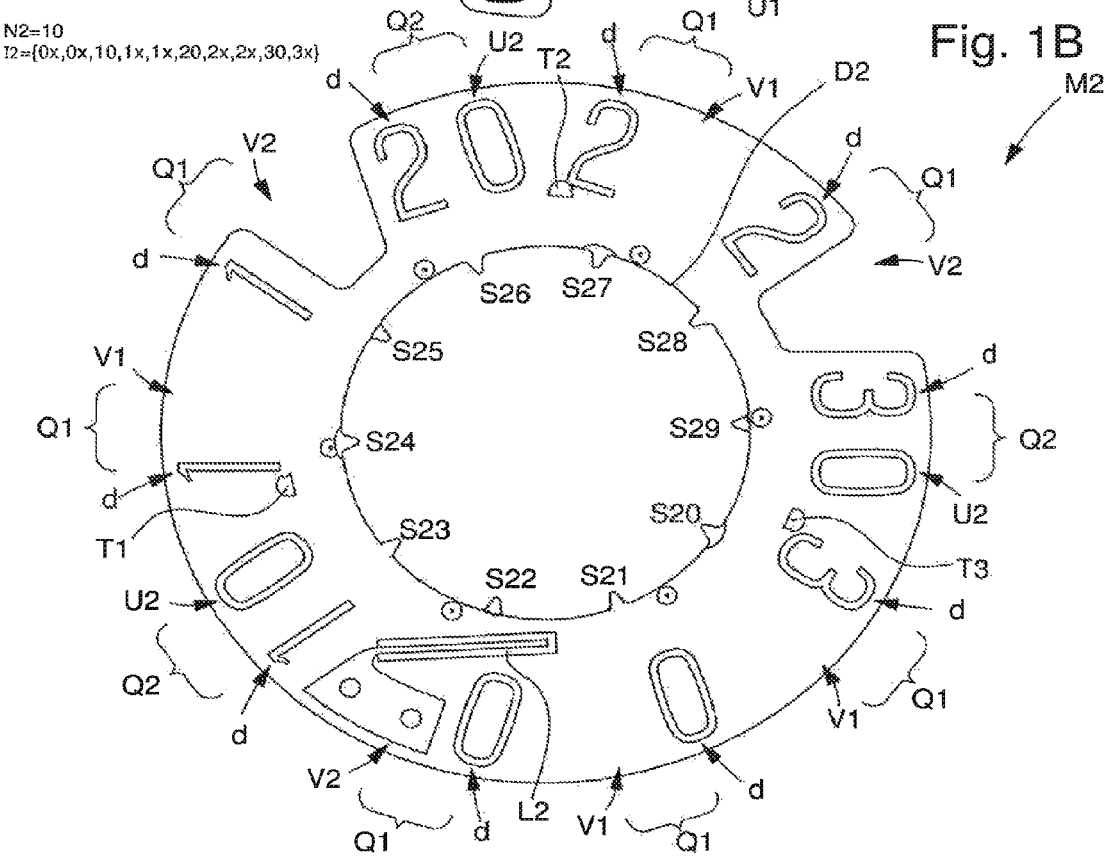

FIGS. 1A and 1B respectively illustrate two discs used for the grand date display according to a preferred embodiment of the invention.

The first disc M1 of FIG. 1A consists of a units disc provided in a conventional manner with 10 display segments respectively referenced S10, S11, S12, S13, S14, S15, S16, S17, S18 and S19, regularly spaced at the periphery of first disc M1, each corresponding to one of the numerals of the series from 1-9, i.e. the complete series of ten units 0-9 from which the numeral {0} has been truncated. The first disc M1 therefore bears a first series of symbols I1 which consists of a first space, followed by a first sequence U1 of first units numerals u1={3,4,5,6,7,8,9}. The first series of symbols I1={Ø, 1-9} thus contains ten display symbols, including 9 units numbers 1-9 and one space Ø corresponding to a second units numeral u2, here the numeral 0, the display of which is shifted to a second series of symbols I2 placed on second disc M2, as seen in FIG. 1B. All the symbols i1 of the first series of symbols I1 are separated from each other by a first recess V0, so as to facilitate the display through combination with a tens numeral d on at least some dates, which will be termed the "first dates" Q1.

The second disc M2 of FIG. 1B is a modified tens disc, which, in addition to bearing the symbols of the four conventional tens numbers (0, 1, 2, 3) can also display dates ending in the units truncated from first disc M1, i.e. only the numeral "0" here. This second disc M2 can consequently display the 10th, 20th and 30th days of the month without requiring combination with first disc M1, and these three aforecited date values are referred to as "second dates" Q2, i.e. date values that are entirely displayed by second disc M2, as opposed to first dates Q1 which are displayed through a combination of symbols of first disc M1 and symbols of second disc M2.

Second disc M2 is also provided with ten display segments referenced S20,S21,S22,S23,S24,S25,S26,S27,S28 and S29, regularly distributed at the periphery of second disc M2, and with a second series of symbols I2={0X,0X,10,1X, 1X,20,2X,2X,30 and 3X}—the value "X" indicating a second recess V1, or a third recess V2 or any other numeral, a symbol of the first disc being intended to be superposed thereon. The number of symbols of the second series of symbols I2 is equal to that of first disc M1, and to the number of display segments, i.e. 10. Such an arrangement is particularly advantageous for the insertion of a control device with superposed gear sectors, which allows for significant space saving, particularly when each of the two display discs M1, M2 has a substantially annular shape, i.e. wherein the geometric shape obtained by scanning all the symbols during one display cycle corresponds to a ring, freeing space at the centre thereof for insertion of a control mechanism. The first display disc M1 and the second display disc M1 can otherwise advantageously be arranged in the form of concentric rings. The first disc M1 is provided with a first main toothing D1 arranged to mesh with a drive wheel and pinion, such as, typically, a 24-hour drive wheel R, illustrated below in FIG. 1C, as is second disc M2, which includes a second main toothing D2 for meshing with said same drive wheel R.

In FIG. 1B, two types of references are shown for the spaces after the tens numerals on second disc M2; the second recesses V1, for a combined display with the numeral "1" of first disc M1, and a third recess V2, corresponding to the two notches in second disc M2 and the positioning of the second leaf L2. When the third recess corresponding to reference V2 is located opposite the display aperture, it will be known that the current display phase is the first indexing sequence, explained below with reference to the series of FIGS. 5A-F, in which the units numbers 2-9 of first disc M1 are presented.

FIG. 1A shows the presence of a first leaf L1, on the display segments referenced S10-S11. As will be seen below, the function of this flexible first leaf L1 is to act as an element for driving second disc M2 via first disc M1 during the indexing of certain dates, notably the change of the tens as a result of cooperation respectively with a first post T1, a second post T2 and a third post T3 integral with second disc M2, seen in FIG. 1B, and which are arranged here in a plane perpendicular to the display plane, namely also a direction parallel to the joint axis of rotation of first disc M1 and second disc M2. It will thus be understood that the angular positioning of this first leaf L1 in a given angular sector depends on the relative angular position of the posts, and it does not necessarily have to be arranged in the aforecited sectors S10-S11 as in the illustration of FIG. 1B; the advantage of the preferred illustrated embodiment is simply to separate the display of the first series of symbols I1 of first disc M1 from the device driving the second disc, which increases clarity. Similarly, FIG. 1B shows the presence of a second leaf L2, provided for driving first disc M1 via second disc M2 during the indexing of certain other dates, particularly the change from dates ending in the number "1" to those ending in "2", as a result of cooperation with notches provided on the inner perimeter of the first disc M1, that is to say:

a first notch E1 for the change 01->02, a second notch E2 for the change 11->12, and finally a third notch E3 for the change 21->22.

These three notches E1, E2, E3 and their relative position with respect to second leaf L2 are visible in the series of FIGS. 5 to 9 relating to the five indexing sequences characteristic of the preferred control mechanism for implementing the display device according to the invention, detailed below.

As can be seen with reference to FIGS. 1A and 1B, the illustrated preferred embodiment is particularly advantageous since the first and second discs each use exactly the same number of display symbols, i.e. the number of first symbols i1 of the first series of symbols I1 of first disc M1 is identical to the number of second symbols i2 of the second series of symbols I2 of the second disc M2, and both are equal to 10. These two series of symbols are also distributed over the same number of display segments, which means that none of the symbols is repeated more than once during each cycle, and the size of each display segment, and thus the size of the displayed numerals, can consequently be maximised. This is therefore a specific situation where the first number N1 of first display segments of first disc M1, i.e. the segments referenced S10 to S19, is equal to the second number N2 of second display segments of second disc M2, i.e. the segments referenced S20 to S29. This configuration facilitates the gear mechanism, and moreover the size of each numeral or space borne by each disc can have an optimum size: indeed, it will be noted that the sizes of the first, second and third recesses V0, V1, V2 of the tens numeral d, and of the first and second units numbers u1-u2 may all be identical, both in terms of size and the angular sector occupied, which provides a particularly homogeneous display and reliable indexing for each of the two discs, and no longer simply for the units disc as in the prior art.

However, although the following description will describe in detail a mechanism for programming display discs using such an advantageous arrangement, it will nonetheless be understood that it is possible, without departing from the scope of the present invention, to transfer the display of some units of first disc 1 to second disc 2, or to use a first disc M1 in the form of a complete units disc with the series 0-9 without thereby changing the number of display segments of each disc or their mutual coupling mechanism. Thus, if instead of simply truncating the numeral 0 from the units sequence, a second sequence U2 of second numerals u2 {0,1} was truncated from the first series of symbols I1 of first disc M1, by removing the symbol "1" from the display segment referenced S11 of first disc M1, it would consequently be possible to envisage using a second modified tens disc M2 bearing a second modified series of symbols I2 {01,0X,10,11,1X,20,21,2X,30,31}—the value "X" then indicating only a third recess V2 or any numeral value, on which would be superposed a numeral from the first series of symbols I1 of first disc M1, the second recesses V1 having been removed—without in any way changing the programming mechanism described below, and in particular without changing the first coupling mechanism 120 or the second coupling mechanism 210. It may easily be noted on reading the following description that the programming mechanism would also not be modified by using a disc M1 that still comprises 10 display segments, but bears a first series of symbols I1 from which one more numeral is truncated, i.e. the second sequence U2 of second numerals u2 {0, 1, 2}, with the symbol "2" removed from display segment S12. The second series of symbols of second disc M2 would then simply have to be adapted to the following sequence {01,02,10,11,12,20,21,22,30,31}, i.e. by removing all the second and third recesses V1, V2 from second disc M2, and adding the second units numeral equal to 2 to the display segments respectively referenced S22,S25 and S28 in FIG. 1B in place of third recesses V2. It would even be possible, again without changing the date programming mechanism described above, and in particular the coupling mechanisms, to use a first disc M1 provided with the first complete series of units 0-9, by adding the symbol "0" to display segment S10. In that case, only the first type of dates Q1 would be systematically displayed, in combination with the symbols of the tens numeral d of the second disc M2, bearing a second modified series I2 of symbols {0X,0X,1X, 1X,1X,2X,2X,2X,3X,3X}, the value "X" then either indicating a second recess V1, provided for display in combination with the units numeral "1" of the first series of symbols I1 of first disc M1, or a third recess V2, provided for display in combination with the units numbers 2 to 9 of the first series of symbols I1 of first disc M1, or another type of recess provided for display in combination with the units numeral "0" of the first series of symbols I1 of first disc M1, or any other numeral. It will be understood from the foregoing that these alternative, non-illustrated embodiments are given simply by way of non-limiting example for comprehension of the operation of the claimed invention, the first symbols of first disc M1 being capable of superposition, because they are identical in size to the second symbols of the second disc M2, on the latter in the second window F2 of the display aperture, illustrated in particular in the following FIGS. 5A, 6A, 7A, 8A, 9A. Consequently it is the units numeral of the first series of symbols I1 that appears in this second aperture F2 and the displayed numeral or the reference corresponding to a particular type of recess in second disc M2 is used here simply to better identify a specific indexing sequence associated therewith.

Figure 1C:
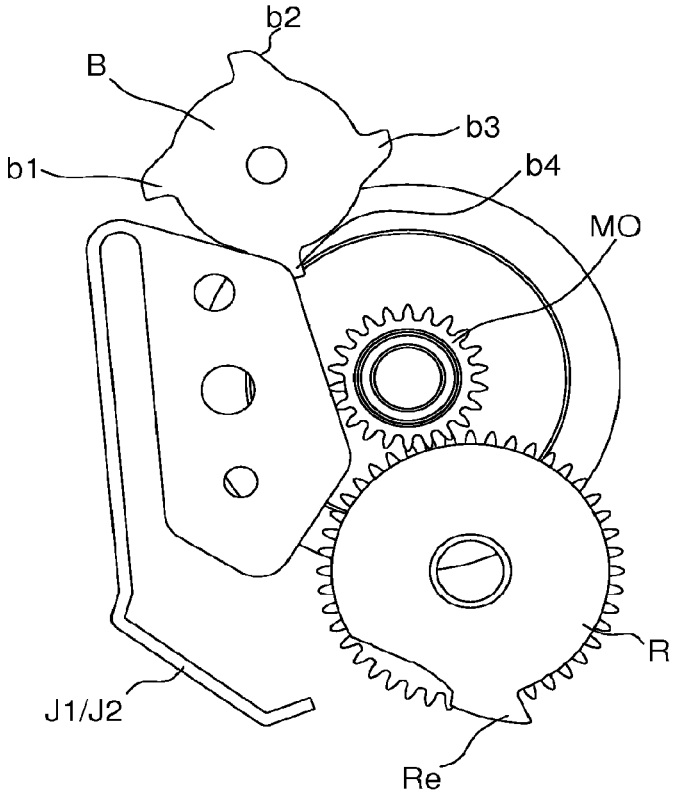
FIGS. 1C and 1D illustrate other constituent parts used by the grand date display device according to a preferred embodiment of the invention.

FIG. 1C shows a top view of a drive mechanism intended to be incorporated in the space freed at the centre of the two display discs M1, M2. There is seen the canon-pinion of the movement M0, which drives, by means of a suitable gear ratio, a 24-hour drive wheel R so that the latter completes exactly one revolution each day. This drive wheel also includes a daily gear sector Re in which are preferably arranged two teeth of identical profile in two different gear planes, namely first daily gear tooth Rd1 and second daily gear tooth Rd2—visible in FIGS. 3A and 3B—intended to mesh respectively with the first main toothing D1 of first disc M1, and the second main toothing D2 of second disc M2, thus forming a preferred embodiment of first main kinematic chain C1 and of second main kinematic chain C2. A corrector wheel set B, commonly called a "sliding pinion", includes a series of 4 correction teeth—first correction tooth b1, second correction tooth b2, third correction tooth b3 and fourth correction tooth b4—spaced at 90° from each other, in order to provide good gear safety and to move sufficiently fast when activated, for example by means of a crown. These teeth of sliding pinion B are respectively intended to drive with a first additional toothing D1' of first disc M1, and a second additional toothing D2' of second disc M2, located in separate gear planes from those of the main toothings, as illustrated below with reference to the pairs of FIGS. 3A-3B and 4A, 4B. The direct connection of sliding pinion B to first additional toothing D1 of first disc M1, and respectively to second additional toothing D2' of second disc M2 form a first additional kinematic chain C1' and a second additional kinematic chain C2' totally separate from the corresponding main kinematic chains for each display disc. Sliding pinion B may be situated in any angular sector inside the free space at the centre of the display rings of first disc M1 and of second disc M2, which leaves great flexibility of arrangement among the nine possible positions. The additional toothings may thus be obtained by a simple circular permutation with respect to the main toothings. The diametrically opposed position of sliding pinion B and 24-hour drive wheel R is thus for a particular case, but this configuration is not essential to accomplish the invention.

Figure 3A:
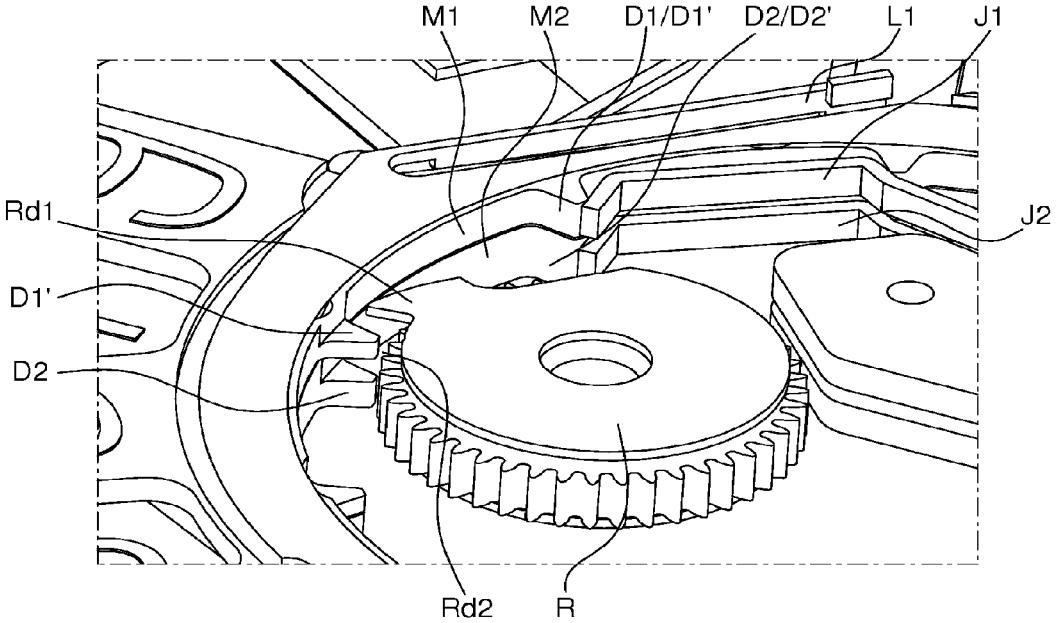
FIGS. 3A and 3B respectively illustrate a three-dimensional view of the mechanism for gearing the various toothings of the first and second disc with the 24-hour drive wheel, and a sectional view of the various gearing planes of each of these toothings, for the example of the change from the 31st day of the month to the 1st day of the following month, according to a preferred embodiment of the grand date display device of the invention.

In order to hold first disc M1 and second disc M2 in indexed positions, there is provided respectively a first jumper J1 and a second jumper J2, which are superposed but separate from each other, as seen in FIG. 3A below; they are arranged on a given display segment and are inserted between two teeth of the toothings of each disc. The thickness of each jumper is preferably extended on the main and additional gear planes of each disc, so that it is possible to hold each disc in an indexed position, i.e. first disc M1 and second disc M2, in the proposed configuration with a 24-hour drive wheel R and a sliding pinion B diametrically opposite each other, since the jumper of each disc (J1 for M1, and J2 for M2) will always be positioned in abutment, between two consecutive display segments, on at least a first tooth of a main or additional gear plane of said disc and a second tooth of a main or additional gear plane of said disc. In other words, the main and additional toothings of each disc never simultaneously present two consecutive toothless gear sectors with this arrangement of 24-hour drive wheel R and sliding pinion B.

Figure 1D:
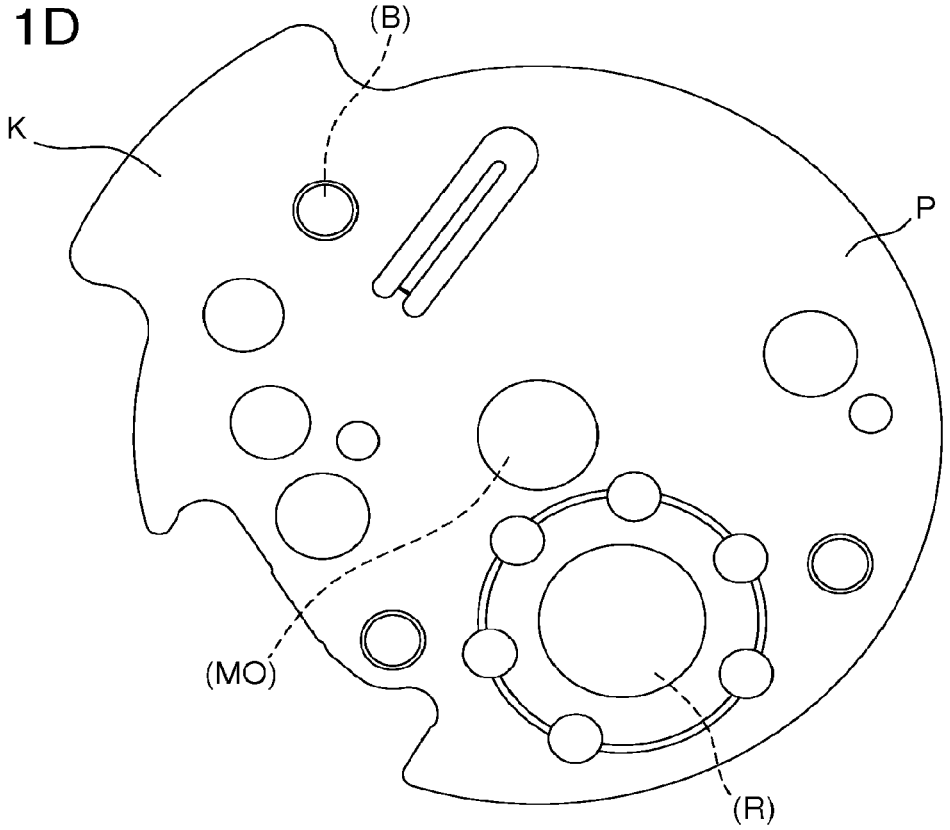

FIG. 1D shows a preferred version of a holding plate P for the drive elements illustrated in FIG. 1C described above. Arrows are shown in dotted lines pointing to the axes of sliding pinion B, of canon pinion M0, and of 24-hour drive wheel R. According to this preferred embodiment, holding plate P contains a fixed gear sector K extending substantially over the width of one display segment and which is intended, as will be seen below with the aid of the gear sequence illustrated in the FIG. 6 series, to allow the date to change to the next ten by means of a coupling element preferably formed by a flexible leaf of the same type as first leaf L1 illustrated in FIG. 1A.

Figure 2A:
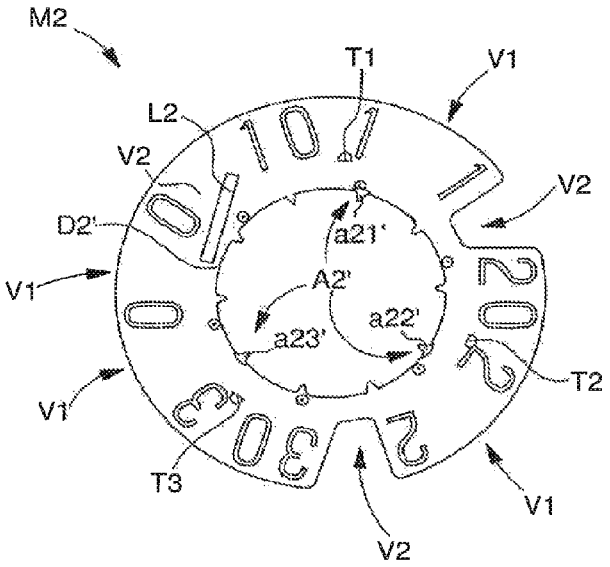
FIGS. 2A, 2B, 2C and 2D respectively illustrate top and bottom views of the first and second disc of FIGS. 1A and 1B, showing various mutual coupling elements in addition to the various toothings acting in distinct gearing planes to daily drive the calendar mechanism and correct the date in a preferred embodiment of the grand date display device according to the invention.
Figure 2C:
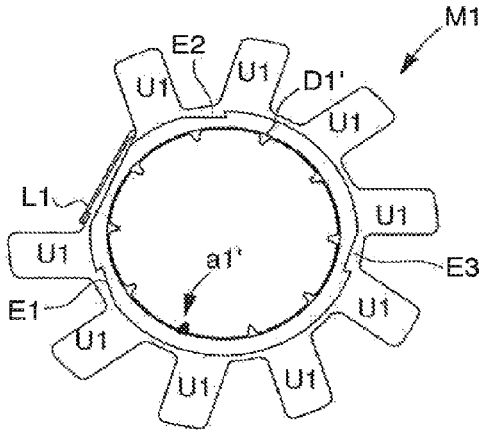
Figure 2B:
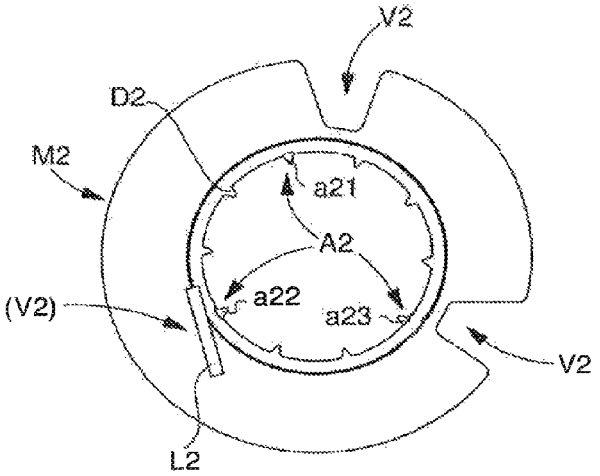
Figure 2D:
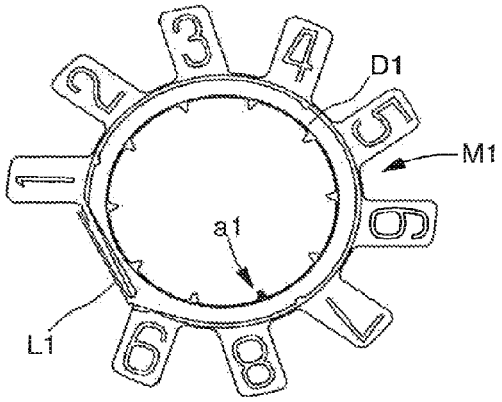

FIGS. 2A and 2B respectively illustrate top and bottom views of second disc M2 of FIG. 1B, whereas FIGS. 2C and 2D conversely illustrate bottom and top views of first disc M1 of FIG. 1A. FIG. 2A again shows the second sequence of symbols I2 {0X, 0X, 10, 1X, 1X, 20, 2X, 2X, 30,3X}, with second recesses V1 for display in combination with symbol "1" of the first disc, and third recesses V2 formed by the notches and the positioning of second leaf L2 driving first disc M1, for display in combination with all the other numerals of the series of units 2-9. These third recesses V2 can be found again in the notches in FIG. 2B, together with the positioning of second leaf L2 by axial symmetry on a horizontal axis with respect to FIG. 2B. However, the four second recesses V1 are no longer shown for reasons of clarity. Although a similar inner toothing of second disc M2 can be seen in FIGS. 2A and 2B, in reality these toothings correspond to a main toothing and an additional toothing, intended to mesh with different wheels in different planes. Thus, in FIG. 2A, the toothing shown corresponds to the second additional toothing D2' of second disc M2, which meshes with sliding pinion B in a second additional plane P2', whereas the toothing shown in FIG. 2B corresponds to the second main toothing D2 of second disc M2, meshing with 24-hour drive wheel R in a second main plane P2. Each of the main and additional second toothings D2 and D2' respectively has a series referenced A2 and A2' of toothless sectors respectively in second main plane P2 and second additional plane P2'. These series of toothless sectors are provided to permit indexing of the first disc M1 in order to present the series of units 2-9 opposite each of the sectors in which the third recesses V2 are arranged (i.e. the notches and the second leaf L2, corresponding to the same indexing sequence) for a combined display, while the second disc M2 remains in place. Each of the two series referenced A2 and A2' respectively includes three toothless sectors, which are deduced from each other by circular permutation according to the relative position of arrangement of 24-hour drive wheel R with respect to that of sliding pinion B. The angular position of the gear segments of second disc M2 is defined according to the position of the aperture on the dial and the position of 24-hour drive wheel R, such that each of the toothless sectors is located opposite the drive wheel when the third recesses V2 of the wheel of the second disc are displayed in the aperture. According to the preferred embodiment that is described and illustrated, as will be noted with reference to the following series of FIGS. 5 to 9 illustrating the various indexing sequences, the display aperture is at 9 o'clock on the dial, and the 24-hour drive wheel R and sliding pinion are respectively arranged approximately at 5 o'clock and 11 o'clock on the plate. The toothless sectors of each of the wheels have been annotated in FIGS. 2A and 2B to reflect this configuration, comprising:

- a first toothless sector in main gear plane P2 of second disc M2 referenced a21, placed in display segment S29 of FIG. 1B, beneath the display symbol "30";
- a second toothless sector in main gear plane P2 of second disc M2 referenced a22, placed in display segment S22 of FIG. 1B, beneath the first display symbol "0X";
- a third toothless sector in main gear plane P2 of second disc M2 referenced a23, and placed in display segment S25 of FIG. 1B, beneath the display symbol "1X".

Similarly, the series of toothless sectors in the additional gear plane of second disc M2 includes:

- a first toothless sector in additional gear plane P2' of second disc M2 referenced a21', placed in display segment S24 of FIG. 1B, just beneath the display symbol "1X" and first post T1;
- a second toothless sector in additional gear plane P2' of second disc M2 referenced a22', placed in display segment S27 of FIG. 1B, just beneath the display symbol "2X" and second post T2; and finally
- a third toothless sector in additional gear plane P2' of second disc M2 referenced a23', placed in display segment S20 of FIG. 1B, just beneath the display symbol "3X" and third post T3.

The two series of toothless sectors A2 and A2' described above are moreover visible in FIG. 1B, although not referenced for reasons of clarity, with the aid respectively of small and medium arcs of a circle facing the toothless sectors of the second main toothing D2 and the second additional toothing D2' of second disc M2.

Figure 3B:
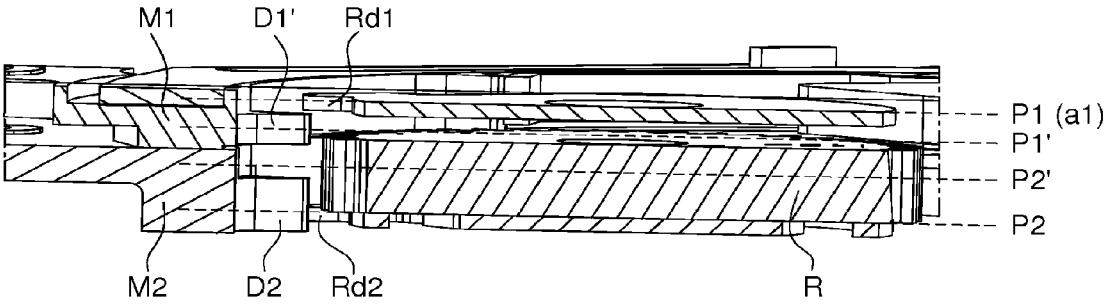
Figure 4A:
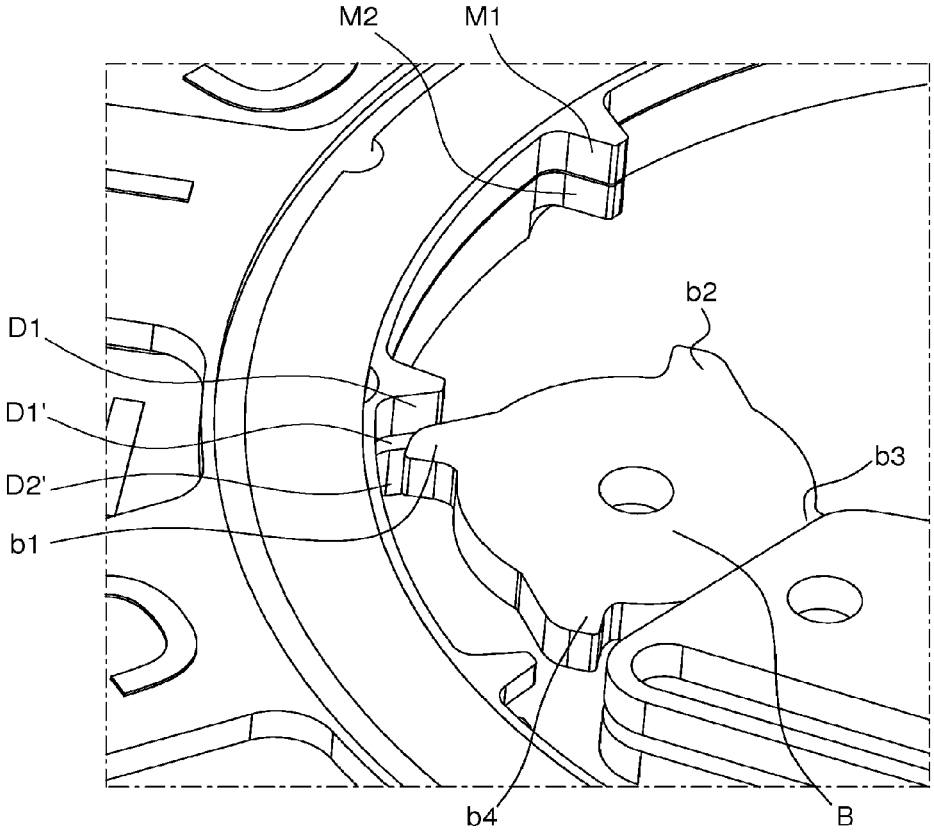
FIGS. 4A and 4B respectively illustrate a three-dimensional view of the mechanism for gearing the various toothings of the first and second disc with the sliding pinion, and a sectional view of the various gearing planes of each of these toothings, for the example of the change from the 31st day of the month to the 1st day of the following month, according to a preferred embodiment of the grand date display device of the invention.
Figure 4B:
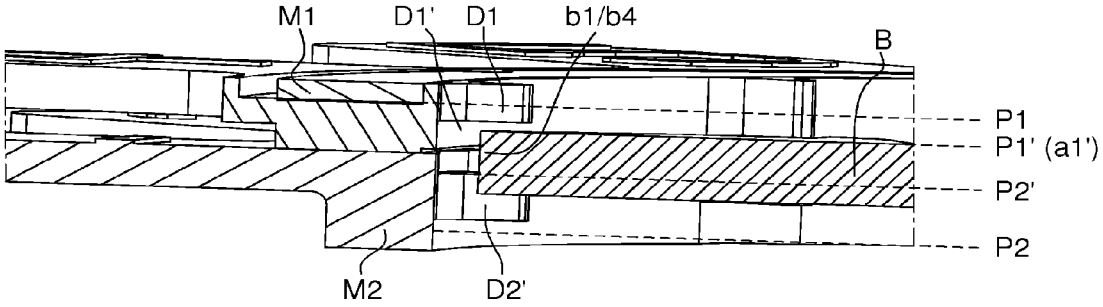

All the main and additional gear planes P1, P2, P1' and P2' are illustrated in FIGS. 3B and 4B below. In FIG. 2A, there is also seen the first drive post T1 for the first ten for the change from the 9th to the 10th day of the month, the second drive post T2 for the second ten for the change from the 19th to the 20th day of the month, and finally the third drive post T3 for the third ten, for the change from the 29h to the 30th day of the month. The angular position of the drive posts depends on the relative position of the aperture, of fixed gear sector K, and flexible first leaf L1 on which the fixed gear sector acts to drive in rotation second disc M2, by pushing first leaf L2 radially outwards into a drive position "PE", illustrated in detail in FIG. 6G; the proposed configuration thus corresponds to that of a gear sector positioned at approximately 11 o'clock, and of a leaf arranged on the display segments corresponding to those of the truncated unit "0" for a display aperture arranged at 9 o'clock on the dial; it will be understood however from the foregoing that other arrangements are possible without departing from the scope of the invention.

FIGS. 2C and 2D respectively show a bottom and top view of the first units disc M1 in which there is seen, in addition to the sequence of first numerals u1 of the units 1-9, also a first leaf L1 for driving second disc M2 with the aid of three posts T1, T2, T3 described above, which are integral with the second disc, and in accordance with the same principle as in FIGS. 2A and 2B above, a main and additional toothing intended to mesh in separate planes with 24-hour drive wheel R for a daily gear engagement, and with a sliding pinion B for manual correction of the date on demand. In FIG. 2D, the first main toothing D1 is identical to that shown in FIG. 1A with 10 equally distributed display segments, intended to mesh in a main plane P1 with 24-hour drive wheel R. In this gear plane, there is seen a toothless sector referenced a1, which is intended to allow indexing of the second disc while leaving first disc M1 stationary. According to the preferred embodiment described, this type of indexing is essential to change from the 31st day of one month to the first day of the next month. Similarly, in FIG. 2C, the first additional toothing D1' is intended to mesh in a first additional plane P1 with sliding pinion B, and there is a corresponding toothless sector a1'.

Referring to the series of FIGS. 2A, 2B, 2C and 2D, it will be noted that the position of the toothless sectors corresponding to each distinct gear plane for the same disc can be deduced by axial symmetry with respect to a vertical axis, since the top and bottom views are symmetrical on a horizontal axis, and the arrangement of the two drive wheel sets, namely drive wheel R and sliding pinion B are arranged symmetrically with respect to the centre of the plate of the movement. The composition of an axial symmetry and a central symmetry actually consists of an axial symmetry on an axis orthogonal to the preceding one.

FIG. 2C also shows a last drive element for allowing the mutual coupling between the first and second disc, namely notches E1, E2 and E3, which are intended to cooperate with second leaf L2 to drive first disc M1 via second disc M2. First disc M1 includes three notches for driving dates ending in "1" to dates ending in "2" according to the preferred embodiment described. More specifically, first notch E1, second notch E2 and third notch E3 are distributed over a cycle of 10 equally distributed segments, i.e. regularly distributed in angular sectors each having the same value, first notch E1 and third notch E2 being separated by 3 segments, second notch E2 and third notch E3 also being separated by 3 segments, and consequently third notch E3 and first notch E1 being separated by 4 segments. The positioning of this series of notches depends on the positioning of second leaf L2 on second disc M2 and also on the position of the display aperture on the dial. According to the preferred embodiment described, where second leaf L2 is positioned on display segment S22 of the figure of FIG. 1B, corresponding to symbol "0X", associated with the third recess V2 configured to drive first disc M1 on the change from the 1st day of the month to the 2nd, so that second leaf L2 then cooperates with second notch E2 for the change of date from the 11th to the 12th, and finally with the third notch E3 for the change of date from the 21st to the 22nd. Thus, on the change from the 31st day of the month to the 1st of the following month, second leaf L2 will be offset by one segment with respect to first notch E1 and in this configuration, due to the missing teeth in the first disc—the toothless sector referenced a1—unlike the other dates ending in "1" above, the first disc M1 will not be driven by the second disc to complete the 31 day cycle of the month. This gear mechanism is explained with reference to the illustrations of the following series of FIGS. 8A-F and 9A-F, which explain in detail respectively the fourth indexing sequence for the change from dates ending in 1 (1st, 11th, 21st) to the next dates ending in 2 (2nd, 12th, 22nd) and the fifth indexing sequence corresponding to the particular case of the change from the 31st to the 1st day of the next month.

FIGS. 3A and 3B respectively illustrate a three-dimensional view of the gearing mechanism of the various toothings of the first and of the second disc with the 24-hour drive wheel and, in particular, the first main toothing D1 meshing in the first main gear plane P1 and the second main toothing D2 meshing in the second main gear plane. The sectional view of FIG. 3B shows the particular arrangement of all the gear planes, including the additional gear planes of each disc, respectively referenced P1' for the first disc and P2' for the second disc, with each of the drive toothings at the change from the 31st day of the month to the 1st day of the following month. According to a preferred embodiment of the described grand date display device of the invention, the first main toothing D1 of the first disc is intended to have a toothless sector a1, while the main toothing dl of the second disc has a tooth. Consequently, the first gear tooth Rd1 of drive wheel R in first main plane P1 does not drive first disc M1, whereas second gear tooth Rd2 of drive wheel R meshes in the second main plane P2 with a tooth of toothing D2 of the second disc. In FIG. 3A, it is seen that the first additional toothing D1 also has no teeth in this gear sector, which makes it possible to clearly separate the different gear planes, which follow each other in the following order from top to bottom: P1, P1', P2', P2, clearly visible in FIG. 3B. It is to be noted, however, in the same FIG. 3A, that the gear sector adjacent arranged at the top has a homogenous toothing D1, D1' and D2, D2' with teeth that extend respectively over the entire depth of first disc M1, and that of second disc M2. It is over this depth that each retaining jumper can extend, respectively first jumper J1 for the first disc and second jumper J2 for the second disc. This arrangement of discs with display segments and gear toothings completely superposed on the inner perimeter of annular-shaped parts for the first and second discs (M1, M2) consequently not only saves space, but also considerably simplifies implementation of the date display programming mechanism.

Similarly, FIGS. 4A and 4B illustrate a three-dimensional view of the gearing mechanism of the various toothings of the first and second discs with sliding pinion B, and particularly the additional toothings for the same example of the change from the 31st day of the month to the 1st day of the following month. As explained above, the sliding pinion does not mesh in the first and second main gear planes P1, P2 of each disc, but in first and second additional gear planes P1', P2', which are juxtaposed and respectively sandwiched between the first and second main gear planes P1, P2, which allows the sliding pinion to be arranged with a certain depth combining the drive toothings of the two discs, thereby obviating the need to machine two separate toothings in two separate planes having the same profile, as for drive wheel R, which reduces production costs. Whatever the position of sliding pinion B on the plate, it must be ensured that the sliding pinion can mesh, by means of one of its four teeth b1-b4 (in FIG. 4A, it will be the second tooth b2 when sliding pinion B is activated) with an identical tooth profile, on the additional gear toothings, to that with which 24-hour drive wheel R meshes, at the same time, on the main toothings. Thus, it is to be noted in FIG. 4B, that there must be one toothless sector—referenced a1'—on the first additional toothing D1' in the first additional gear plane P1', since there was a toothless sector referenced a1 on the first main toothing D1 in the first main gear plane P1 (see FIG. 3B); similarly there will be a tooth on second additional toothing D2' for this gear sector in second additional gear plane P2', since there was one on the second main toothing D2 in the second main gear plane P2 (see FIGS. 3B and 4B for comparison).

It will be understood from the example described above, corresponding to the fifth gear sequence described below with reference to the FIG. 9 series, in connection with the FIG. 2 series described above, that each of the first and second discs M1, M2 respectively has a first and a second main daily gear toothing D1, D2 that meshes selectively with a 24-hour drive wheel R according to the date, depending on whether or not a tooth is present. Drive wheel R thus forms the starting point of the first main kinematic chain C1 for driving first disc M1, and also the starting point of a second main kinematic chain C2 for driving second disc M2. The various toothings of the two discs form a first part of the overall programming mechanism, for respectively directly driving each of the discs. The date display programming mechanism is then completed by the second part, formed by the mutual bidirectional coupling mechanism between the first and second disc on certain dates, namely in the preferred example described and illustrated by the Figures, for the tens of the date (09->10, 19->20, 29->30) and the dates where the units change from 1 to 2 (01->02, 11->12, 21->22).

The mechanism for coupling first disc M1 to second disc M2 is thus formed, according to the preferred embodiment described, by driving the posts (respectively first, second and third posts T1, T2, T3) by means of first leaf L1 three times during a 31-day month cycle, first leaf L1 being integral with the first disc M1 comprising 10 display segments and consequently having a more limited cycle of a maximum of 10 indexed positions. An active position of leaf L1—referenced "PE" for "drive position" in FIG. 6G—is determined by the fixed gear sector K arranged on plate P, which extends at least over the width of one display segment and must at least make it possible to drive the second disc for the change to the next ten, that is to say the change from the 9th to the 10th day of the month, from the 19th to the 20th day of the month, and from the 29th to the 30th day of the month. It will be understood that in a non-illustrated variant, this fixed gear sector K could extend over a greater width and thus maintain the drive position "PE" of first leaf L1 not only for the change to the aforecited next ten, but also the subsequent change from "0" to "1".

The second mechanism 210 for coupling second disc M2 to first disc M1, also schematically illustrated in FIG. 10 described above, consists, in the preferred embodiment described, in driving notches (respectively first, second and third notches E1, E2, E3) oriented by a second leaf L2, integral with second disc M2, and arranged obliquely towards the inner perimeter of first disc M1. According to the preferred embodiment described, the presence of three notches spaced in a defined manner, (cycle of 3/3/4 over 10 equidistant angular segments) is necessary to allow meshing from the 1st to the 2nd, then from the 11th to the 12th, and finally from the 21st to the 22nd and then to stop the driving on the last day of the month (31st), although this date also ends in the unit numeral "1".

Although in the preferred embodiment proposed, the first and second coupling mechanisms 120, 210 between the two display discs use flexible leaves respectively cooperating with posts and notches, it will be understood that other variants are possible, especially using double toothings having a suitable profile. For example, a pivoting retractable tooth could replace the first flexible leaf L1 and still be actuated in position by means of fixed gear sector K, or be replaced by a long tooth, and then mesh with another type of drive element, such as, for example, a radial extension in the gear plane of the pivoting tooth replacing the posts, which, in functional terms, are simply stop members, and consequently do not necessarily need to consist of pins arranged along the common axis of rotation of the two discs perpendicular to their display plane. Likewise, other drive elements and stop members could be employed for the second coupling mechanism 210, which does not necessarily require a flexible element. Thus, a double toothing with a profile arranged on first disc M1 cooperating with another profile arranged on second disc M2 could also be suitable for implementation of the desired coupling mechanism.

The advantage of the preferred embodiment illustrated is that the manufacture of the flexible or non-flexible drive elements can be achieved by stamping and thus results in significant cost savings.

In the series of FIGS. 5 to 9 which follow, there will be described 5 essential indexing sequences in the preferred embodiment using first disc M1 and second disc M2 illustrated in FIGS. 1A and 1B, and the 10-segment programming mechanism for each of these discs. These series of Figures are intended to show the relative angular positions of the two discs in relation to each other, and the positions of the mutual coupling elements, namely here first leaf L1 with respect to each of posts T1, T2, T3 and respectively second leaf L2 with respect to each of notches E1, E2, E3 in relation to each other. To facilitate the reader's understanding, the symbols of the first disc M1 are shown in solid characters, in order to distinguish them from those of the second disc M2 and to make it possible intuitively to see whether the display is of a first date Q1 or of a second date Q2.

Each of FIGS. 5A, 6A, 7A, 8A and 9A and respectively 5D, 6D, 7D, 8D and 9D show the current date displayed through an aperture made in a dial C, and which is formed here by a first window F1 for the display of the tens numeral d and a second window F2 for the display of the units numeral, respectively before and after an indexing step. The dates displayed through the aperture correspond either to a first date Q1, when the first numeral u1 is displayed using symbols borne by the first disc M1, or to a second date Q2, when the units numeral is a second units numeral u2 truncated from first disc M1, namely here "0" borne by second disc M2.

Figure 5A:
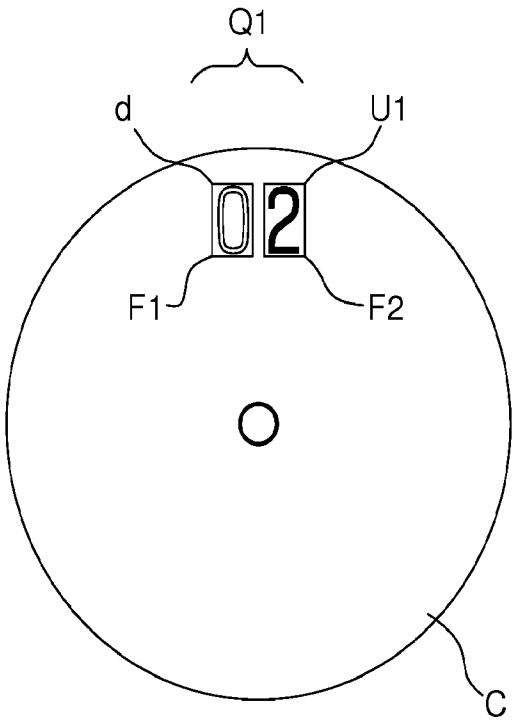
FIGS. 5A, 5B and 5C respectively illustrate the date through an aperture in the dial, and the relative positions of the first and second discs, seen from above and from below, for the 2nd day of the month.

The FIG. 5 series, namely FIGS. 5A, 5B, 5C, 5D, 5E and 5F illustrate a first indexing sequence for date values where the units are comprised between 2 and 9, namely a total of 7 indexing steps for the changes: 2-3, 3-4, 4-5, 5-6, 6-7, 7-8 and 8-9. This indexing sequence is repeated 3 times in one monthly cycle, with the units numeral "d" which may be equal either to 0, or to 1, or to 2. FIG. 5A illustrates the date "02" displayed through an aperture in dial C, before indexing, and FIGS. 5A and 5B respectively show the relative positions of the first and second discs M1, M2, in top and bottom views. In this position, the 24-hour drive wheel R faces the first toothless sector a21 of second toothing D2 of the second disc, seen in FIG. 5B, which is thus not driven in rotation, whereas the first toothing D1 of first disc M1 has one tooth to be driven by drive wheel R for each of the dates from 2 to 8. All the dates displayed during this sequence are first dates Q1 for which first units numerals u1 are visible in the second display window F2.

Figure 5B:
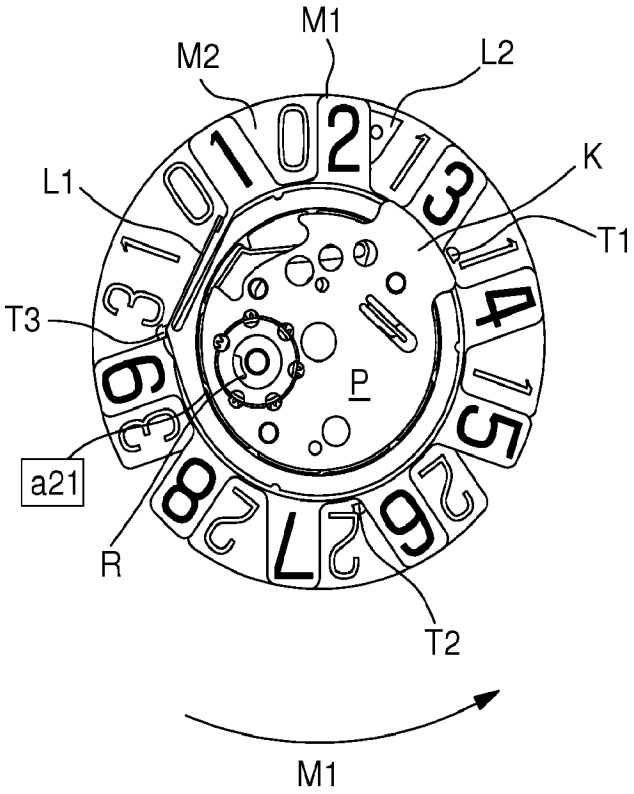
Figure 5C:
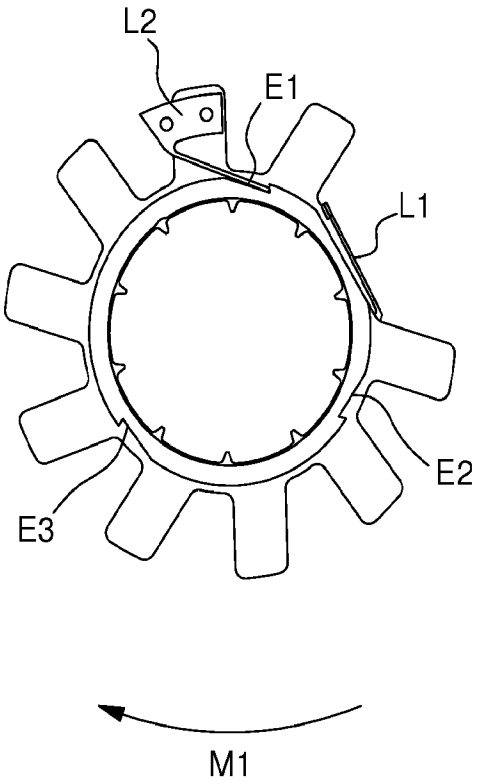
Figure 5D:
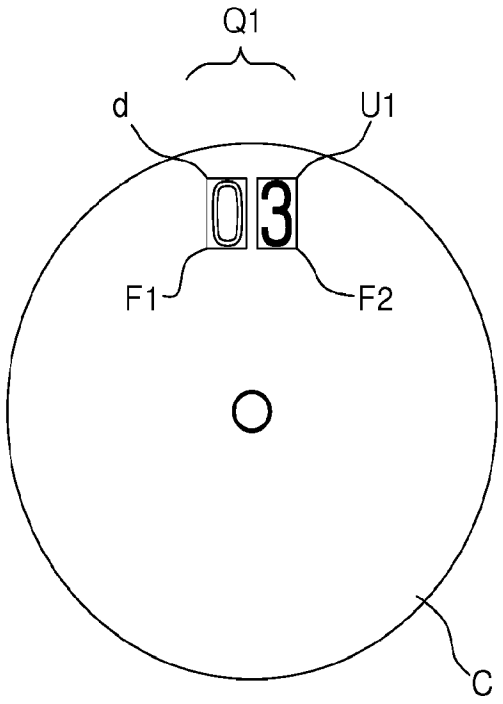
FIGS. 5D, 5E and 5F are the same views as FIGS. 5A, 5B and 5C above but following the change to the 3rd day of the month.
Figure 5E:
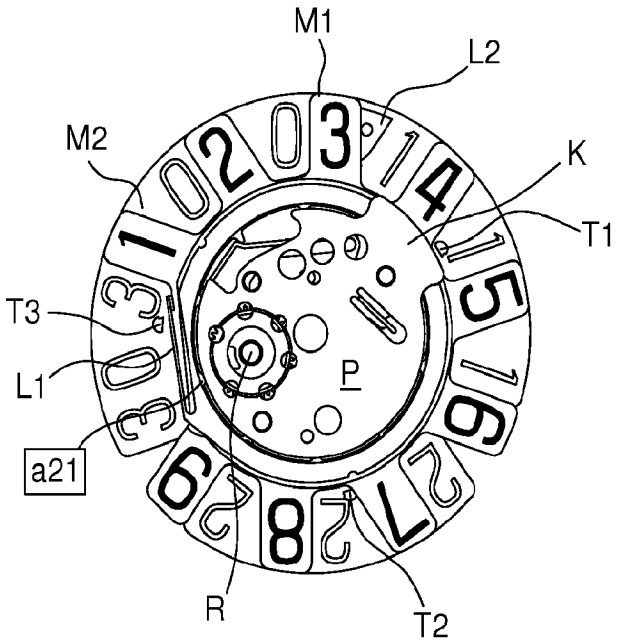
Figure 5F:
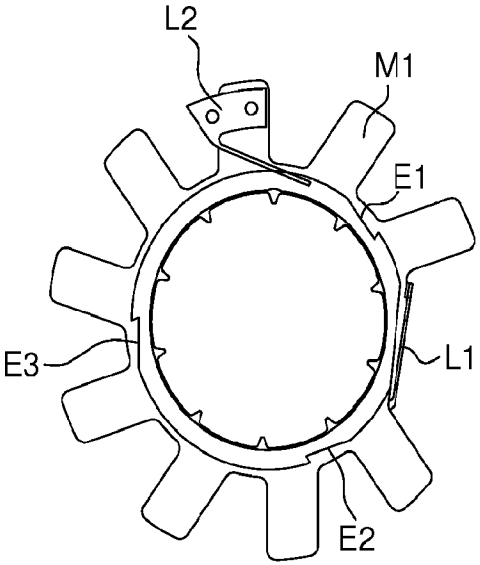

In FIG. 5B, it is seen that second leaf L2 is located at the aperture, and in FIG. 5C, it is seen that this second leaf engages with first notch E1. During each indexing of this first sequence, first disc 1 rotates in the direction of rotation indicated by the arrows seen in FIGS. 5B and 5C and the orientation of second leaf L2 and that of each of the notches, that is to say first notch E1, second notch E2, and third notch E3, allows first disc M1 to slide on this second elastic leaf L2. As can be observed in FIGS. 5E and 5F which show the same views as FIGS. 5B and 5C, after the change to the 3rd day of the month, second leaf L2 has remained in the same position, so that 24-hour drive wheel R is still facing the first toothless sector a21 of second toothing D2 of the second disc, whereas first disc M1 has shifted by one display segment, so that second leaf L2 no longer engages with any of the notches. At the end of this first indexing sequence, i.e. for the 9th day of the month, second leaf L2 will no longer be engaged with first notch E1, but with third notch E2 at the end of the first cycle, and it will be understood that the relative position of the first and second discs M1, M2 will change from the engagement of second leaf L2 with second notch E2 for the 12th day of the month to engagement with third notch E3 for the 19th day of the month, and from engagement with third notch E3 for the 22nd day of the month to a position shifted by one display segment with respect to the first notch—as in FIG. 5F—for the 29th day of the month, to allow the last indexing of the fifth sequence from the 31st day of the month to the 1st of the following month explained with reference to the series of FIG. 9 below.

During this first indexing sequence, the fixed gear sector K of plate P has not been used, it will be used for the second indexing sequence illustrated in FIGS. 6A-G together with the first leaf L1 integral with first disc M1.

Figure 6A:
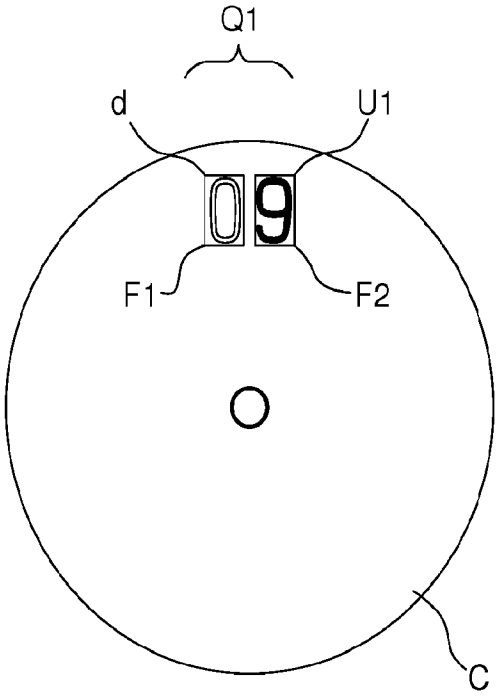
FIGS. 6A, 6B and 6C respectively illustrate the date through an aperture in the dial, and the relative positions of the first and second discs, seen from above and from below, for the 9th day of the month.
Figure 6B:
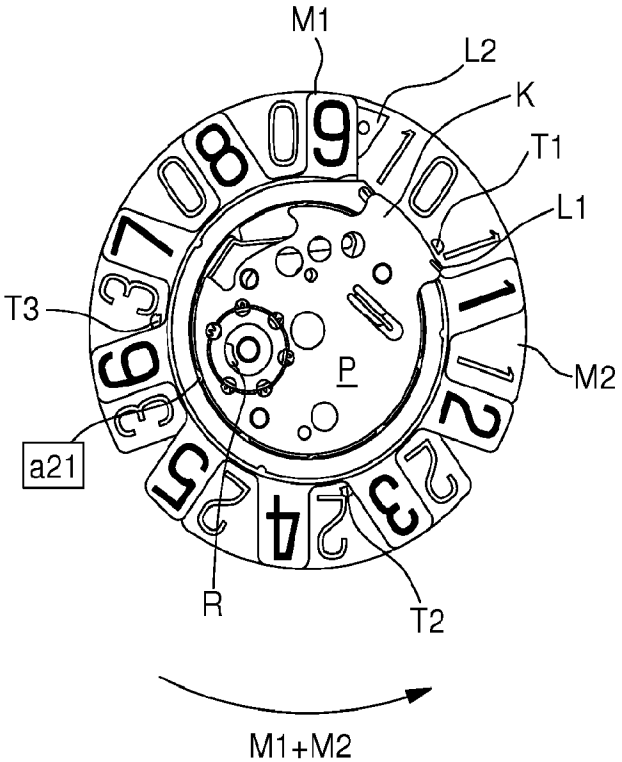
Figure 6C:
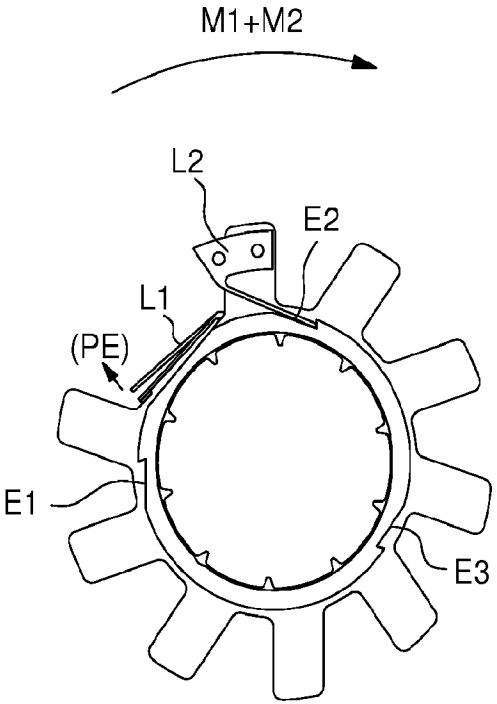
Figure 6D:
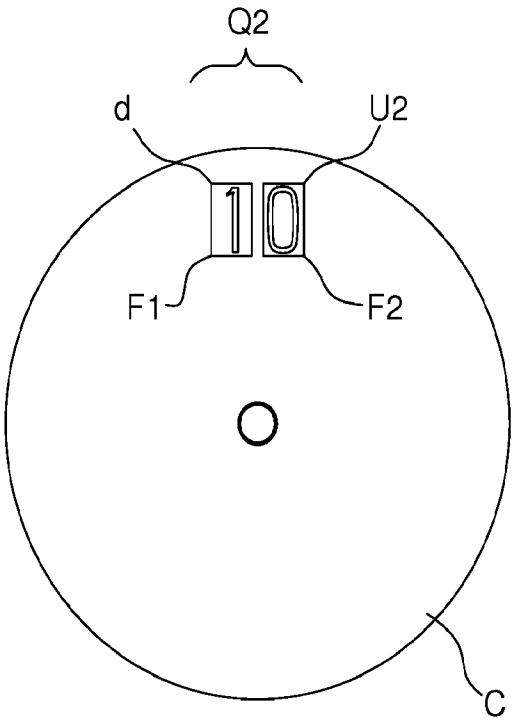
FIGS. 6D, 6E and 6F are the same views as FIGS. 6A, 6B and 6C above but following the change to the 10th day of the month.
Figure 6E:
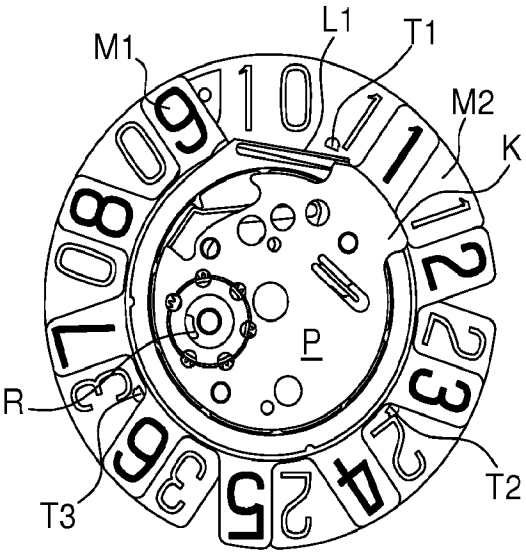
Figure 6F:
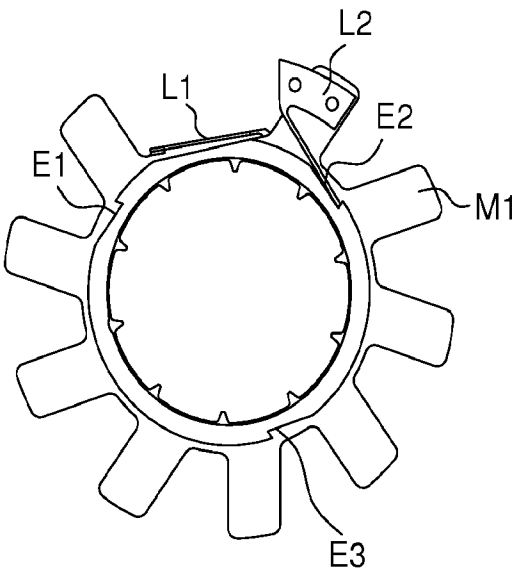

FIGS. 6A and 6D illustrate the change from a first date Q1-09 here-to a second date Q2-10 here. In fact, if the first tens numeral d is still displayed via the second disc, the first units numeral u1 "9" is displayed by first disc M1 whereas there is a change to a second units numeral u2 "0" no longer displayed by first disc M1, but by second disc M2.

Figure 6G:
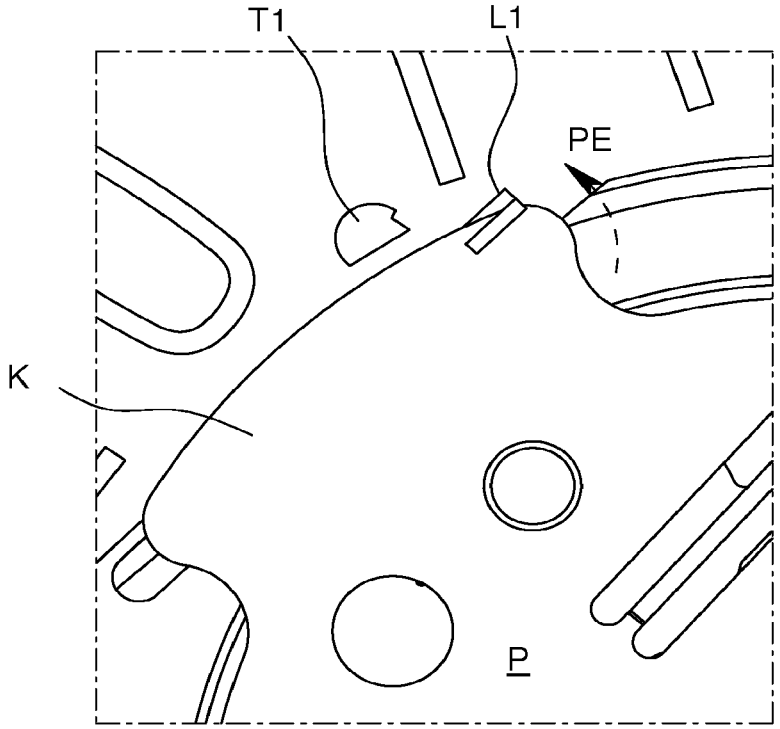
FIG. 6G illustrates a detailed view showing the gearing of a leaf of the first disc with a post of the second disc for the mutual driving thereof in rotation.

During this second indexing sequence, the two discs rotate together, since first disc M1 drives second disc M2. As can be seen in the detail of FIG. 6G, the first leaf L1 is pushed outwards into an active position by fixed gear sector K of holding plate P, i.e. the drive position referenced "PE", so that it drives first post T for the change to the first ten. It will be understood that there is a similar coupling mechanism for each tens change, using the same gear sector K, but which will respectively push first leaf L1 in drive position PE towards second post T2 to change from the 19th day of the month to the 20th, and towards third post T3 to change from the 29th day of the month to the 30th.

As can be seen in FIG. 6B, second leaf L2 is still positioned facing the aperture whereas the last unit of the first series of symbols 11 of first disc M1 is now also facing second window F2. As explained above, and as can be observed in FIG. 6C, this second leaf L2 is now positioned in second notch E2. To overcome the presence of the first toothless sector of second disc M2, referenced a21, which is still facing 24-hour wheel R, and therefore is not driving second disc M2 in rotation, whereas first disc M1 is driven via tooth on its first gear toothing D1 (not referenced in this Figure for reasons of legibility), the mechanism for coupling second disc M2 by first disc M1 via first post T1 driven by first leaf L1 makes it possible to drive second disc M2 and first disc M1 jointly in rotation by one display segment in the direction of rotation indicated in FIGS. 6B and 6C. Indeed, it can be observed in FIGS. 6E and 6F that second leaf L2 is still facing second notch E2, but that it is shifted by one display segment (downwards in FIG. 6E which is a top view, and upwards in FIG. 6F which is a bottom view).

Figure 7A:
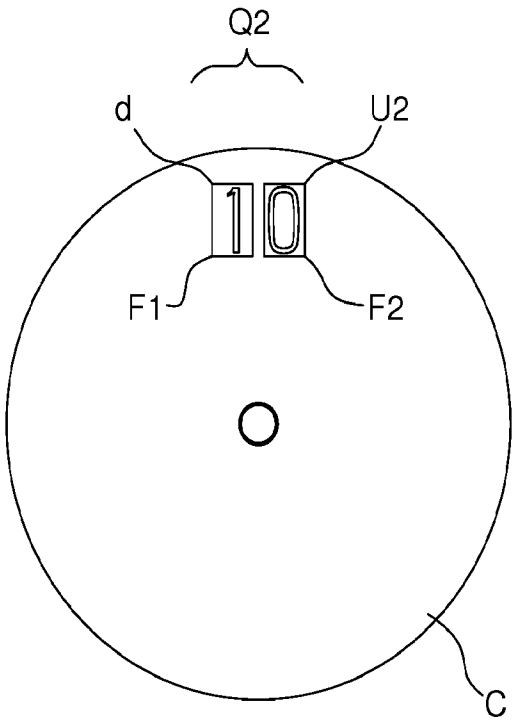
FIGS. 7A, 7B and 7C respectively illustrate the date through an aperture in the dial, and the relative positions of the first and second discs, seen from above and from below, for the 10th day of the month.
Figure 7B:
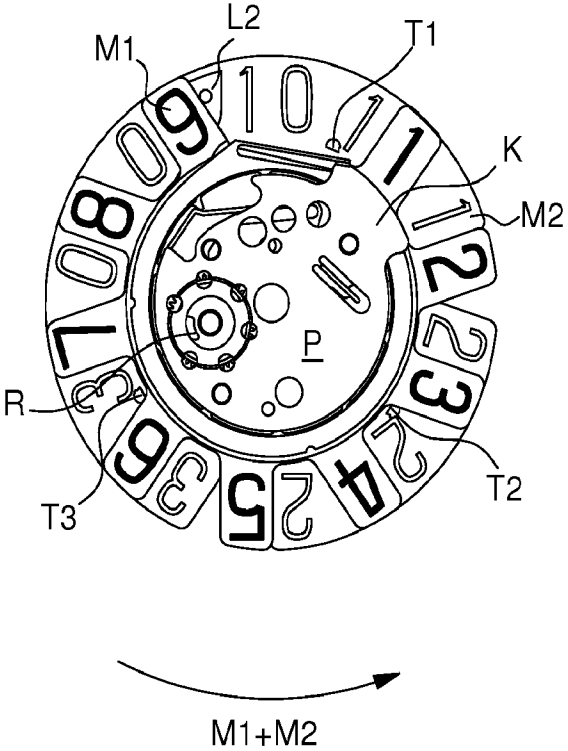
Figure 7C:
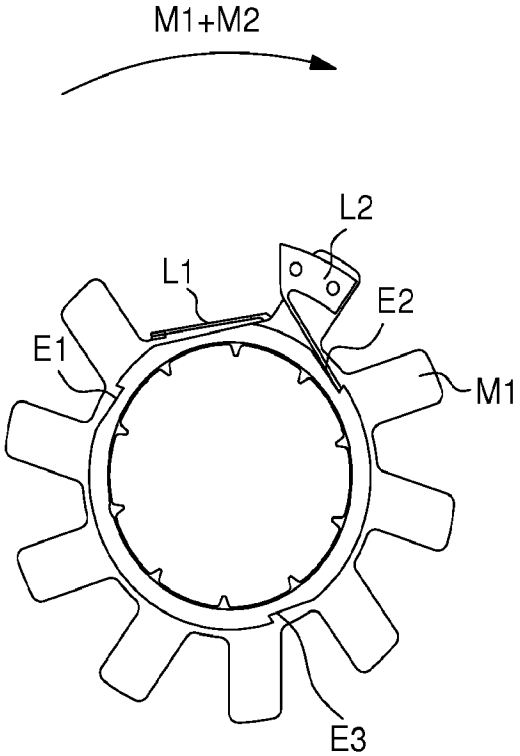
Figure 7D:
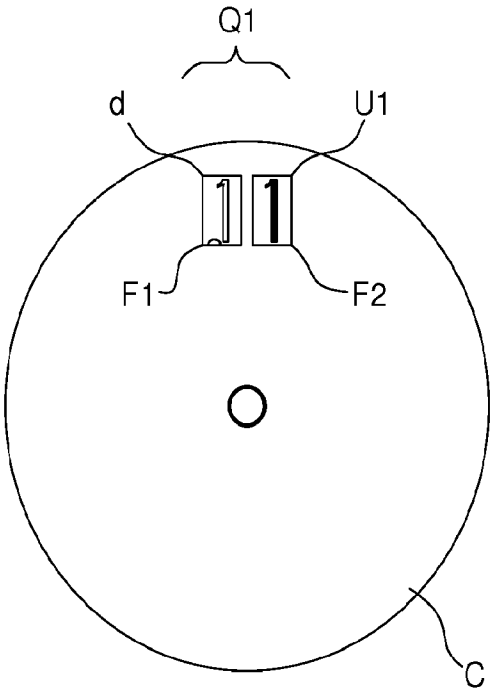
FIGS. 7D, 7E and 7F are the same views as FIGS. 7A, 7B and 7C above but following the change to the 11th day of the month.
Figure 7E:
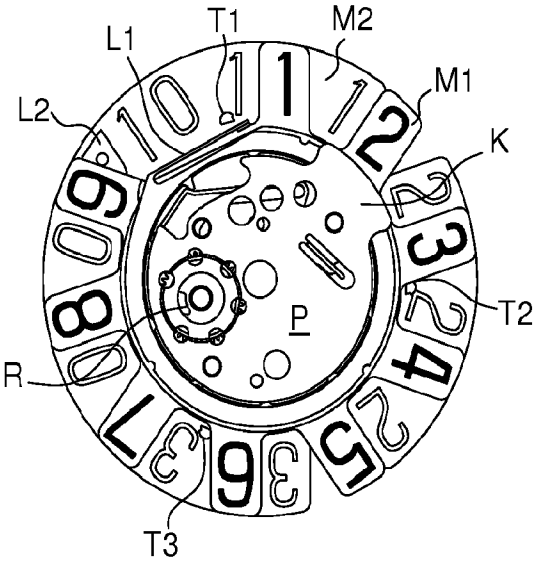
Figure 7F:
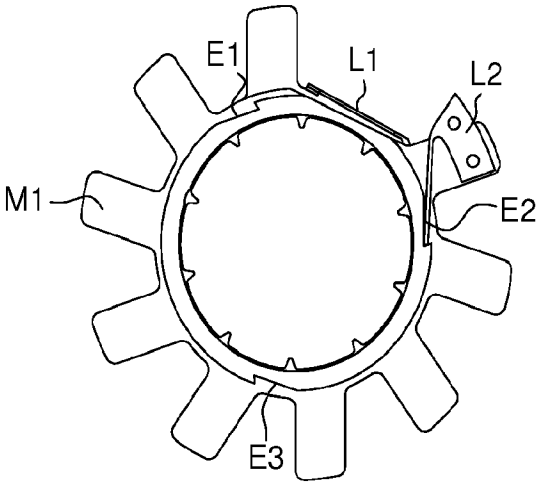

The third sequence illustrated by the series of FIGS. 7A to 7F show the change from a second date Q2 to a first date Q1 again, since this is the change from a date ending in "0", i.e. a second numeral u2 truncated from the first series of symbols I1, to a date ending in "1", which is the first units numeral of the first sequences of symbols 11 of the first disc. According to the preferred embodiment described here, the mode of driving the first and second discs M1 and M2 is very simple, since the first main toothing D1 of first disc M1 and the second main toothing D2 of second disc M2 each contain a tooth that meshes with drive wheel R, so that the coupling mechanism of the invention is not used. It will be understood, however, that in an alternative embodiment, fixed gear sector K could be enlarged so that first leaf L1 is always pushed outwards in its drive position PE to always drive first stud T1, so that a tooth is not required on second main toothing D2 of second disc M2 to drive the latter, which would be driven in that case through coupling to first disc M1, that is to say still by means of the first coupling mechanism 120 described above with reference to the series of FIGS. 6A-G. Further, given that second leaf L2 is still positioned in second notch E2 in this position, one tooth could be removed from the first main toothing D1 at this location and first disc M1 would, in that case, be driven by second disc M2. Similar reasoning applies for the change of dates 20-21 where first leaf L1 could still drive second post T2, or alternatively second leaf L2 could still drive first disc M1 by means of third notch E3; for the change of dates 30-31, it would be first leaf L1 that could still drive third post T3, however, with second leaf L2, no alternative would be possible for driving first disc M1, since the leaf will be shifted by one display segment with respect to first notch E1, as in the fifth sequence, illustrated by the series of FIGS. 9A-F explained below. FIGS. 7B and 7C, which respectively show a top and bottom view, illustrate the relative positions of the first and second discs M1 and M2, with the direction of rotation of both discs which rotate simultaneously during indexing. For these alternative embodiments (not illustrated), it will be understood that the first and second additional toothings D1' and D2' will be adjusted according to the profile of the modified first and second main toothings D1 and D2. FIGS. 7A and 7D show the indexed position of an additional display segment of each of the two discs M1, M2, with second leaf L2 which is still engaged with the second notch but now two display segments below the aperture formed by the first display window F1 and the second display window F2. For the change from the 20th to the 21st day of the month, the angular position of first disc M1 would remain unchanged, but the second leaf of second disc M2 would be positioned at approximately 3 o'clock on the dial, and in third notch E3, as though in FIG. 7F, only second leaf L2 had been moved to be placed in third notch E3. For the change from the 30th to the 31st, the position of first disc M1 would be identical to that of FIGS. 7B/7C before indexing and 7E/7F after indexing, and the position of second disc M2 would be identical to that which it occupied in FIGS. 9B and 9C.

The fourth indexing sequence illustrated in FIGS. 8A-8F corresponds to the indexing of dates where the units end in "1" to dates where the units end in "2", namely between two dates Q1 displayed through a combination of first disc M1 and second disc M2. For these dates, first disc M1 is positioned such that first toothing D1 has a toothless sector a1, referenced in FIG. 8B, in order to allow second disc M2 to be driven at the end of the month—for the date "31" which also ends in a "1"—without first disc M1, which is the subject of the fifth sequence illustrated by FIGS. 9A-9F below, and which therefore constitutes a particular case of the fourth sequence described below.

Figure 8A:
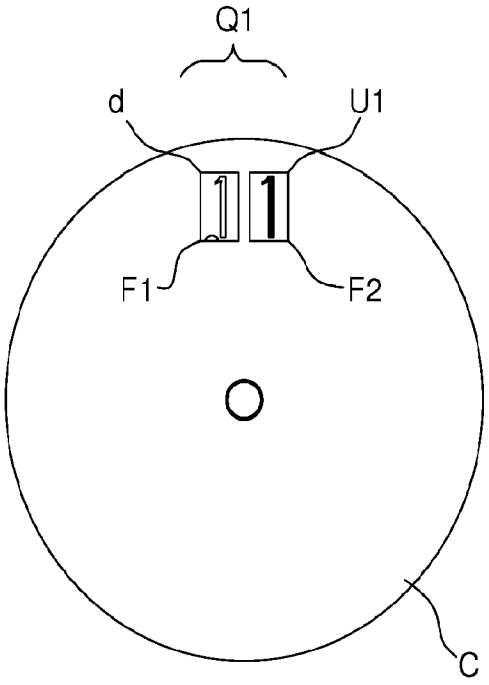
FIGS. 8A, 8B and 8C respectively illustrate the date through an aperture in the dial, and the relative positions of the first and second discs, seen from above and from below, for the 11th day of the month.
Figure 8B:
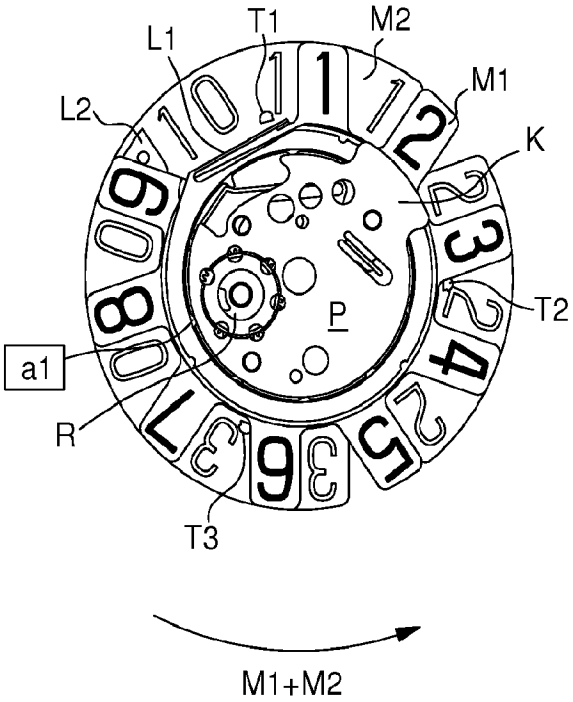
Figure 8C:
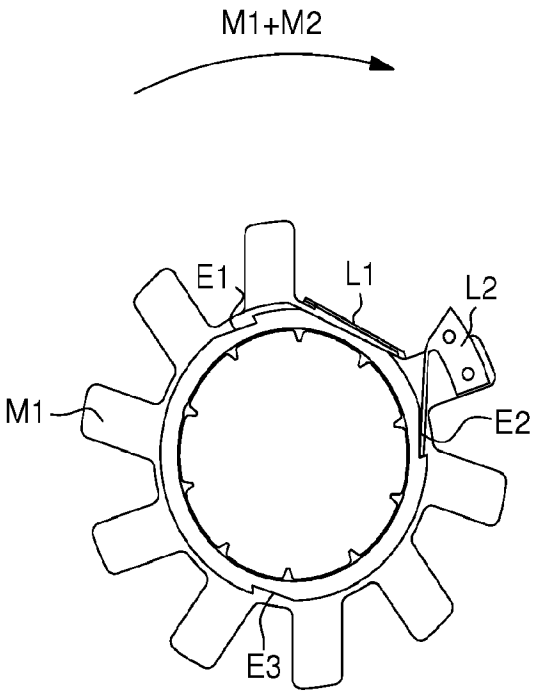
Figure 8D:
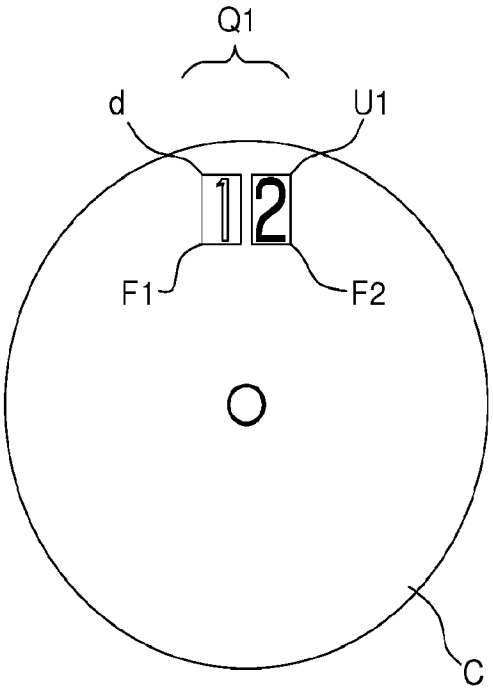
FIGS. 8D, 8E and 8F are the same views as FIGS. 8A, 8B and 8C above but following the change to the 12th day of the month.

For the 11th day of the month, as illustrated in FIG. 8A, second leaf L2 of second disc M2 engages in second notch E2 of the first disc, so that, even in the absence of teeth on the first main toothing D1 of first disc M1, the latter is driven in rotation by second disc M2, driven by 24-hour drive wheel R through an additional display segment in the direction of rotation indicated by the arrows in FIGS. 8B and 8C. The relative position of the two discs consequently remains unchanged between FIGS. 8B/C and 8E/F, since each of the discs has been rotated such that the first units numeral "2" of the first sequence U1 of first numerals u1 is displayed in the second window of the aperture, whereas second leaf L2 is superposed on the display segment of the last numeral 9 of the first symbols of first disc M1, at substantially 6 o'clock on the dial. This sequence is repeated, like all the other preceding indexing sequences, three times each month, all that changes for indexing from the 1st to 2nd day of the month with respect to the illustrations of the series of FIGS. 8A-8F is the position of second leaf L2 which is engaged with first notch E1 instead of second notch E2, with the position of second leaf L2 changing from an angular position of approximately 10 o'clock on the dial to approximately 9 o'clock on the dial, facing the aperture at the end of indexing, as in FIGS. 5A/5B of the first indexing sequence described above, and to which the calendar mechanism will then return. For indexing from the 21st to the 22nd day of the month, second leaf L2 will engage with third notch E3, and the angular position of second leaf L2 will change from a substantially 3 o'clock position on the dial, to a 2 o'clock position on the dial.

Figure 8E:
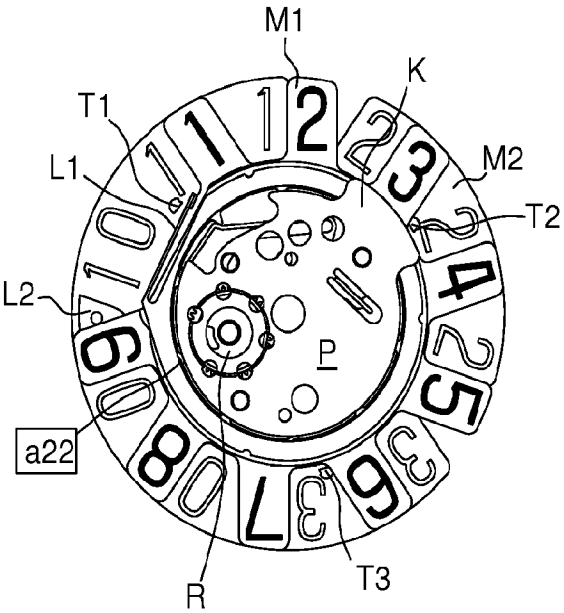
Figure 8F:
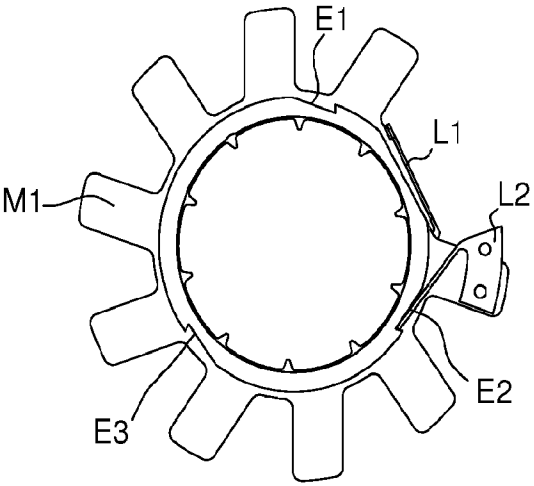

At the end of each of these three possible indexing steps for this fourth indexing sequence, it will be noted that drive wheel R changes from a display segment where first main toothing D1 of first disc M1 is provided with a first toothless sector a1, to the next display segment where the second main toothing D2 is provided with a toothless sector, namely: the first toothless sector referenced a21 for the 2nd day of the month (see FIG. 5B), the second toothless sector referenced a22 in FIG. 8E for the 12th day of the month and finally the third toothless sector referenced a23 for the 22nd day of the month.

The series of FIGS. 9A-9F concern the fifth and final indexing sequence which, unlike the four indexing sequences previously described, is only performed once per month, whereas the other four are each performed three times. As explained above with reference to FIGS. 8A-F relating to the fourth indexing sequence, the fifth indexing sequence is a particular case of the fourth indexing sequence in the specific situation where the second disc M2 is driven only by one tooth of second main toothing D2, whereas the absence of teeth on first main toothing D1—toothless sector referenced a1 in FIG. 9B—and the absence of a coupling mechanism between the first and second display discs means that second disc M2 rotates alone, without first disc M1.

Figure 9A:
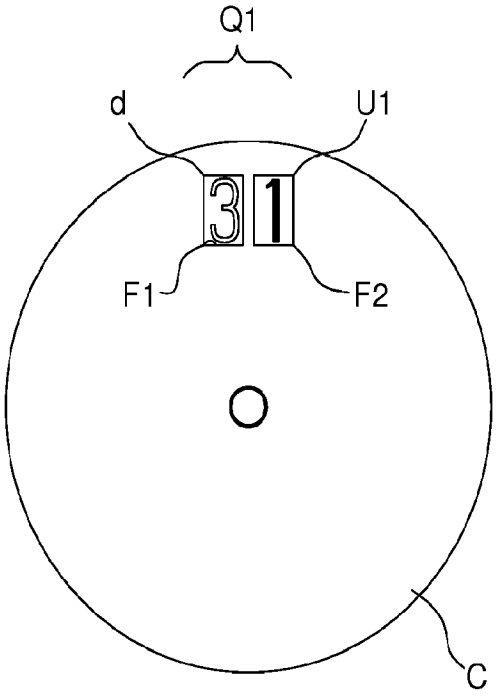
FIGS. 9A, 9B and 9C respectively illustrate the date through an aperture in the dial, and the relative positions of the first and second discs, seen from above and from below, for the 31st day of the month.
Figure 9B:
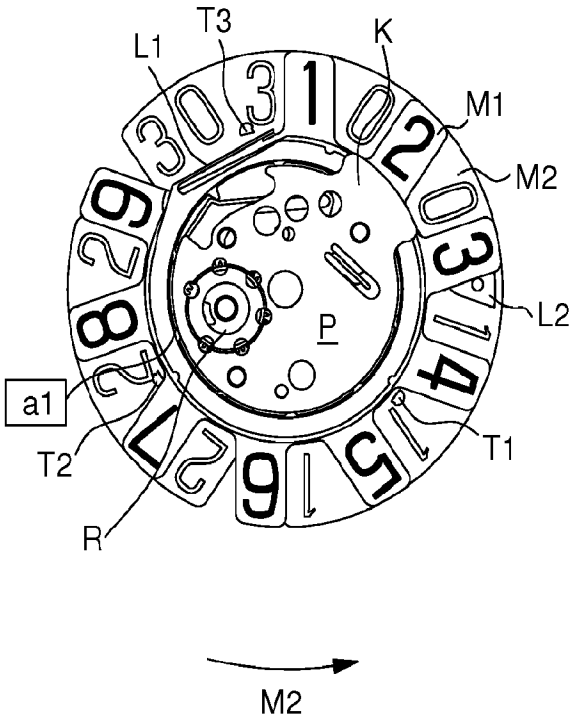
Figure 9C:
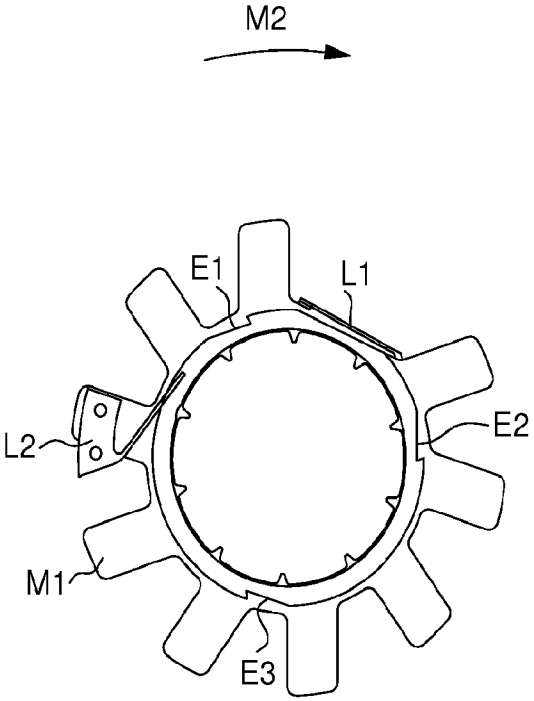
Figure 9D:
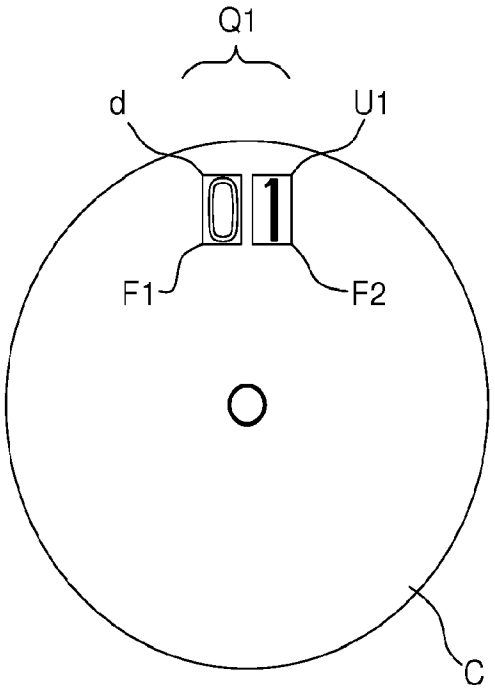
FIGS. 9D, 9E and 9F are the same views as FIGS. 9A, 9B and 9C above but following the change to the 1st day of the next month.
Figure 9E:
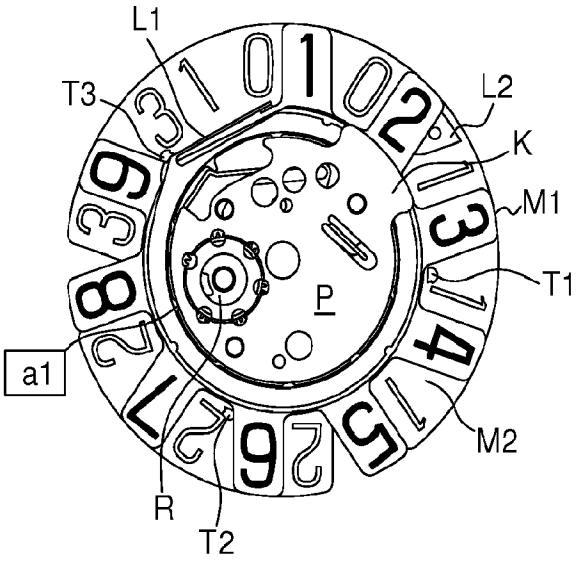
Figure 9F:
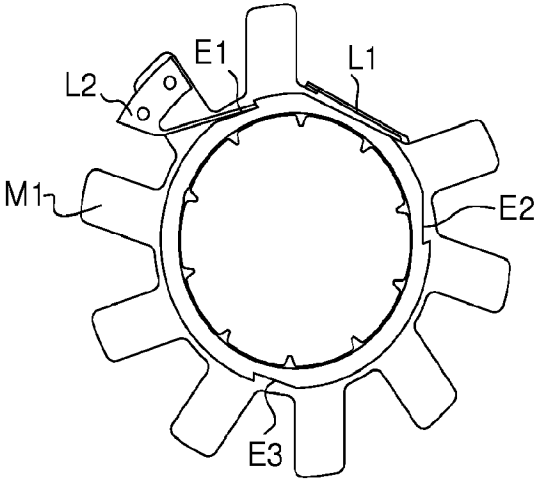

As can be observed by comparing FIGS. 9A and 9D, respectively showing the symbols before and after indexing from the 31st day to the 1st day of the next month, this sequence changes from a first date Q1 displayed through a combination of the two discs to another first date Q1. The angular position of first disc M1, seen in FIGS. 9B and 9C, does not change during indexing and is found again in FIGS. 9E and 9F. Consequently the same toothless sector referenced a1 is seen again in FIG. 9E. As can be observed in FIG. 9C, this is due to the fact that the relative angular position of first disc M1 with respect to second disc M2 is such that second leaf L2 is not engaged in first notch E1, so that any driving by mutual coupling is impossible. Second leaf L2 could, however, drive first disc M1 again by means of first notch E1 after second disc M2 has rotated, and this mutual engagement can be checked in FIG. 9F after this fifth indexing sequence, which will then immediately allow for indexing in the fourth indexing sequence described in the preceding paragraphs.

Once this indexing has been performed, a whole display cycle is completed and the angular position of the two discs is identical with respect to the aperture, namely the second leaf integral with second disc M2 and the units numeral U of value "2" are located substantially at 10 o'clock on the dial, i.e. the angular segment just above that corresponding to the display aperture formed by the first and second windows F1 and F2, which are located at 9 o'clock on the dial.

It will be understood from the foregoing that other display alternatives are possible for the grand date display device proposed, with, in particular, a display using symbols whose characters are oriented tangentially and not radially on each of the discs, unlike the preferred embodiments described. Other display variants using other programming and coupling mechanisms between the two display discs are also possible, especially with retractable pivoting teeth that engage radially and not vertically, and for example, concentric display discs formed of a disc and a ring, or even of two non-concentric discs provided with an unequal number of symbols and display segments.

What is claimed is:

1. A grand date calendar display device for a watch movement comprising a first disc and a second disc, said first and second discs being arranged to display, at least on certain dates, first date values through a combination of symbols borne by said first disc and symbols borne by said second disc, wherein the device includes a first mechanism for coupling said first disc to said second disc, and a second mechanism for coupling said second disc to said first disc such that, at least on certain dates, said first disc drives said second disc, and on certain other dates, said second disc drives said first disc.

2. The grand date calendar display device according to claim 1, wherein said first disc comprises a first main toothing arranged to mesh with a 24-hour drive wheel via a first main kinematic chain, and wherein said second disc comprises a second main toothing arranged to mesh with said 24-hour drive wheel via a second main kinematic chain.

3. The grand date calendar display device according to claim 1, wherein said first disc further comprises a first additional toothing arranged to mesh with a sliding pinion via a first additional kinematic chain, and wherein said second disc comprises a second additional toothing arranged to mesh with a sliding pinion via a second additional kinematic chain.

4. The grand date calendar display device according to claim 1, wherein said first disc is a units display disc bearing a first series of units symbols, wherein said second disc is a tens display disc comprising a second series of symbols for the display of at least the tens numerals of said date, and wherein said first and second discs are formed by superposed and concentric annular elements.

5. The grand date calendar display device according to claim 1, wherein said first coupling mechanism is formed by a first drive element integral with said first disc, cooperating with a fixed gear sector to determine a drive position, and at least a second drive element integral with said second disc, said first drive element being arranged to drive said second drive element integral with said second disc at said fixed gear sector.

6. The grand date calendar display device according to claim 5, wherein said first drive element integral with said first disc is formed by a first flexible leaf, and wherein said second disc comprises a plurality of second drive elements formed by a first post, a second post and a third post.

7. The calendar display device according to claim 5, wherein said first coupling mechanism is arranged to index at least the date values changing to a higher value tens numeral.

8. The grand date calendar display device according to claim 1, wherein said second coupling mechanism is formed by a third drive element integral with said second disc cooperating with at least a fourth drive element integral with said first disc.

9. The grand date calendar display device according to claim 8, wherein said third drive element is formed by a second flexible leaf integral with said second disc, and wherein said first disc comprises a plurality of fourth drive elements formed by a first notch, a second notch and a third notch.

10. The display device according to claim 8, wherein said second coupling mechanism is arranged to index at least the date values where a units numeral changes from 1 to 2.

11. The grand date calendar display device according to claim 4, wherein units numerals of said first series of symbols and second symbols of said second series of symbols are regularly distributed respectively on ten first display segments of said first disc and ten second display segments of said second disc.

* * * * *